US009540017B2

(12) United States Patent
Huelsmann et al.

(10) Patent No.: US 9,540,017 B2
(45) Date of Patent: Jan. 10, 2017

(54) APPARATUS FOR AUTOMATED TRANSFER OF LARGE-SCALE MISSILE HARDWARE

(71) Applicant: Raytheon Company, Waltham, MA (US)

(72) Inventors: Eric P. Huelsmann, Tucson, AZ (US); Kenneth A. Tucker, Tucson, AZ (US)

(73) Assignee: Raytheon Company, Waltham, MA (US)

( * ) Notice: Subject to any disclaimer, the term of this patent is extended or adjusted under 35 U.S.C. 154(b) by 613 days.

(21) Appl. No.: 13/889,161

(22) Filed: May 7, 2013

(65) Prior Publication Data

US 2014/0331889 A1 Nov. 13, 2014

(51) Int. Cl.
*B61B 13/00* (2006.01)

(52) U.S. Cl.
CPC ..... *B61B 13/00* (2013.01)

(58) Field of Classification Search
CPC ..... B61D 3/16; G21F 5/14; B61B 13/00
See application file for complete search history.

(56) References Cited

U.S. PATENT DOCUMENTS 2,334,335 A * 11/1943 Lathrop ..... B61D 45/003 105/362
3,827,365 A * 8/1974 Coppel ..... B65G 1/0414 104/127
4,475,072 A * 10/1984 Schwehr ..... A61B 6/0457 318/280
4,641,823 A * 2/1987 Bergman ..... A61B 5/0555 5/81.1 HS
5,044,846 A * 9/1991 Richardson ..... B60P 7/12 376/272
6,280,127 B1 * 8/2001 Spilker ..... B60P 7/18 410/120
6,286,435 B1 * 9/2001 Kassab ..... B61D 3/16 105/171
6,896,457 B2 * 5/2005 Halliar ..... B60P 7/135 410/36
7,419,329 B1 * 9/2008 Tafoya ..... B63C 3/06 114/44
7,444,952 B1 * 11/2008 McGann ..... B63B 59/06 114/222
8,353,523 B2 * 1/2013 Pedersen ..... B60P 3/40 280/404
8,753,050 B2 * 6/2014 Cyrus ..... B60P 3/40 410/120
9,096,237 B2 * 8/2015 Kutschera ..... B60P 3/035
2002/0029719 A1 * 3/2002 Matsukawa ..... B61B 13/00 104/287
2006/0261218 A1 * 11/2006 Mace ..... B61F 5/386 246/169 R
2006/0285937 A1 * 12/2006 Wobben ..... B60P 3/40 410/45

(Continued)

*Primary Examiner* — Jason C Smith

(57) ABSTRACT

A cradle drive system includes a cradle drive sled. The sled includes a pin configured to mechanically couple the sled to a cradle. The cradle is configured to hold a hardware load for movement along a factory rail. The sled also includes a power interface configured to provide torque to move a hardware load. The sled further includes processing circuitry configured to, in response to determining that the sled is mechanically coupled to the cradle, transfer the cradle and hardware load longitudinally along the factory rail.

20 Claims, 21 Drawing Sheets

(56) References Cited

U.S. PATENT DOCUMENTS

| | | | | |
|---|---|---|---|---|
| 2007/0189895 | A1* | 8/2007 | Kootstra | B60P 3/40 416/9 |
| 2007/0193470 | A1* | 8/2007 | Mochizuki | F16H 57/0487 104/287 |
| 2008/0045831 | A1* | 2/2008 | Cho | A61B 5/0555 600/415 |
| 2008/0145170 | A1* | 6/2008 | Lisenby | B61D 3/16 410/49 |
| 2011/0188975 | A1* | 8/2011 | Salmoiraghi | B65G 67/02 414/392 |
| 2012/0101508 | A1* | 4/2012 | Choi | A61B 19/2203 606/130 |
| 2014/0331889 | A1* | 11/2014 | Huelsmann | B61B 13/00 104/287 |
| 2014/0352572 | A1* | 12/2014 | Basily | B61D 23/025 105/450 |

* cited by examiner

APPARATUS FOR AUTOMATED TRANSFER OF LARGE-SCALE MISSILE HARDWARE

TECHNICAL FIELD

The present disclosure is directed generally to systems that provide automated transfer of hardware. More specifically, this disclosure is directed to systems and methods for automated transfers of large-scale missile hardware from an assembly workstation to an automated guided vehicle or from an automated guided vehicle to an assembly workstation.

BACKGROUND OF THE DISCLOSURE

In an industrial manufacturing facility, large-scale hardware, such as a missile weighing 8,000 pounds or more and extending approximately 24 feet long or, is assembled on stationary assembly work stations. When appropriate, the large-scale hardware is moved from one assembly location in an industrial facility to another assembly location. For the move, the large-scale hardware may be enclosed in a canister (also referred to as "encanistered"), and then manual labor, involving several people performing a critical lift via hoist, is used to transfer the canister to a wheeled-cart. Other examples of large-scale hardware include the canister, and a missile subassembly. The manual labor of 6-8 people is used to push the carted canister to a different area within a factory. The manual labor of 4 people is used to push a carted subassembly to a different area within the factory.

SUMMARY OF THE DISCLOSURE

This disclosure provides systems and methods that eliminate critical lifts or manual movement from the process of moving large-scale hardware to various assembly stations within an industrial facility. The present disclosure provides systems and methods for a zero-lift hardware transfer. The zero-lift hardware transfer is an automated transfer of large-scale hardware from an assembly work station onto an automated guided vehicle (AGV), and onto an assembly work station in a different location.

According to embodiments of the present disclosure, a cradle drive system includes a cradle drive sled. The sled includes a pin configured to mechanically couple the sled to a cradle. The cradle is configured to hold a hardware load for movement along a factory rail. The cradle drive system also includes a power interface configured to provide torque to move a hardware load. The sled further includes processing circuitry configured to, in response to determining that the sled is mechanically coupled to the cradle and detecting a satisfactory manual cradle brake condition, transfer the cradle and hardware load longitudinally along a common factory rail (CFR).

Certain embodiments may provide various technical advantages depending on the implementation. For example, a technical advantage of some embodiments may include transferring large-scale reducing risk of drops or damage to expensive, volatile hardware. A technical advantage of certain embodiments may include significant improvement to factory-workplace ergonomics by eliminating more than a dozen critical lifts and by eliminating manual labor of pushing large heavy carts. A technical advantage of certain embodiments may include the capability of transferring less than a whole assembly, such as subassemblies or components. Certain embodiments may include the capability for providing intelligent transfer between a commercial off the shelf (COTS) factory-wide transportation vehicle (for example, automated guided vehicles) and a stationary assembly work-station.

Although specific advantages are described above, various embodiments may include some, none, or all of the enumerated advantages. Additionally, other technical advantages may become readily apparent to one of ordinary skill in the art after review of the following figures and description.

BRIEF DESCRIPTION OF THE DRAWINGS

For a more complete understanding of the present disclosure and its advantages, reference is now made to the following description taken in conjunction with the accompanying drawings, in which like reference numerals represent like parts.

DETAILED DESCRIPTION

Figure 1:
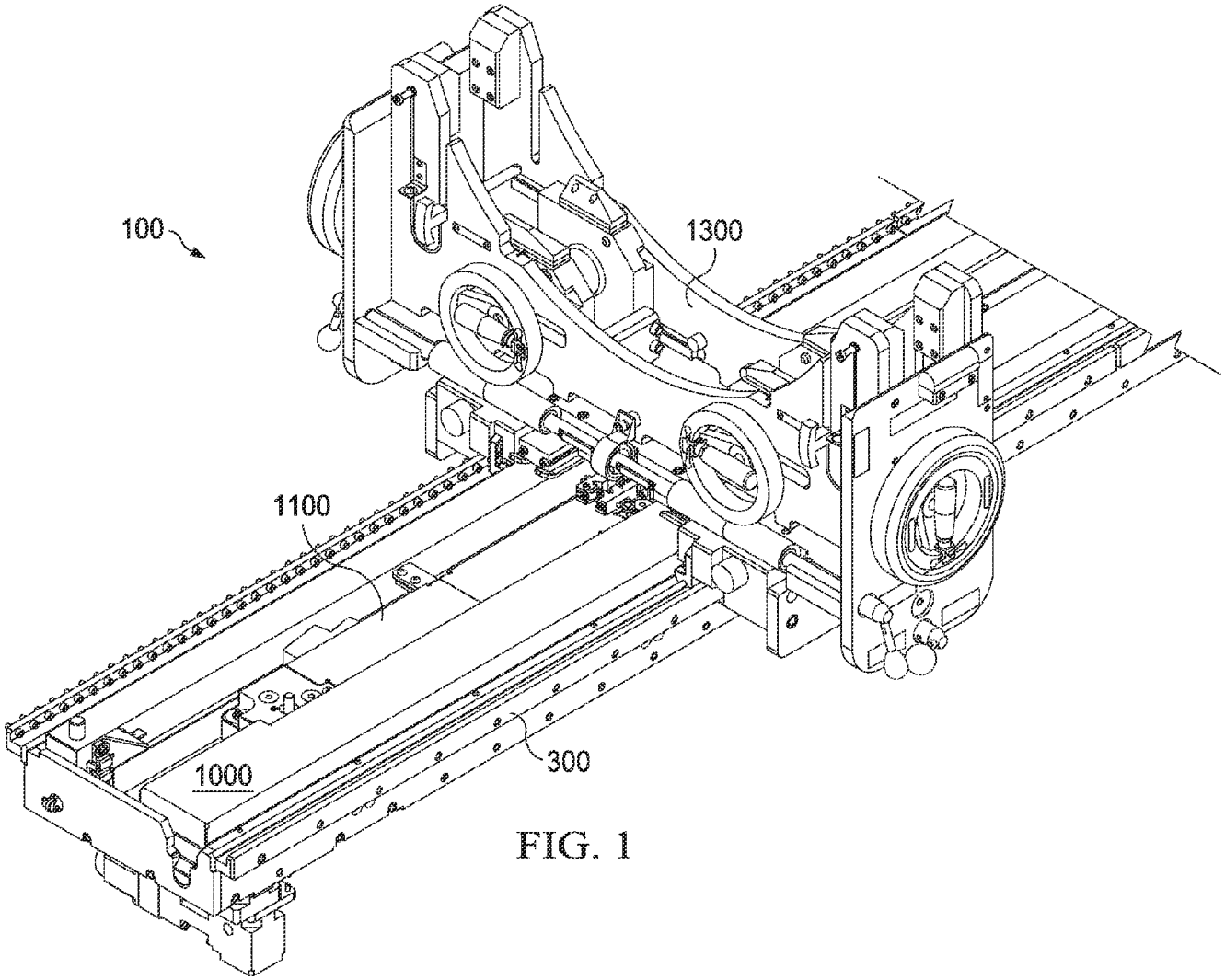
FIG. 1 illustrates an automated transfer and positioning system for large-scale hardware according to embodiments of the present disclosure.

FIGS. 1 through 20, described below, and the various embodiments used to describe the principles of the present disclosure in this patent document are by way of illustration only and should not be construed in any way to limit the scope of the example implementations, drawings, and techniques described below. Those skilled in the art will understand that the principles of the present disclosure invention may be implemented in any type of suitably arranged device or system. Additionally, the drawings are not necessarily drawn to scale.

A factory assembly work station is stationary in order to allow for stable assembly of large-scale components and hardware. Examples of large-scale hardware include, but are not limited to, complete Guided Missile Round (GMR) and All-up-Round (AUR).

A single factory assembly work station is often used to assemble a whole missile assembly in order to reduce risk of damaging subassemblies associated with lifting or otherwise manually transferring subassemblies from one location to another. The stationary assembly work station may be long (such as 48 feet or longer) in order to allow the complete assembly and the complete encanistering and decanistering of the whole missile assembly (namely, large-scale hardware extending 24 feet and weighing up to 8000 or more pounds).

In certain factories, it may be advantageous to assemble subassemblies at a several separate, stationary, smaller assembly work stations throughout the factory, and to combine the subassemblies at one or a few large assembly work stations. For example, a missile factory may include a smaller propulsion subassembly work station, a smaller a separate guidance subassembly work station, and a large work station to combine the two. A wheeled cart provides factory-wide transportation. A commercial off the shelf (COTS) automated guided vehicle (AGV) provides factory-wide transportation according to embodiments of the present disclosure. The AGV is capable of moving a large-scale hardware in various directions and across long distances (e.g., 500 feet). One way of transferring assemblies between stationary assembly work stations is to encanister the assembly for protection against drops or other damage. In some instances, subassemblies or complete assemblies are not encanistered while transferred between stationary assembly work stations. Then, several people (approximately 6-8 people) are required to manually lift (using hoist and push) the assembly or subassembly (using approximately 4-6 people) from the work station onto the cart. After transportation on the cart, several people are again required to manually lift, via hoist and push, the assembly or subassembly from the cart onto the next stationary work station.

In certain factories, the risk of damage associated with manual lifting and transferring outweighs the advantages of utilizing several subassembly work stations. Moreover, with increased sizing of parts, movement of such parts becomes untenable.

Given the above concerns, certain embodiments of the disclosure provide an automated, modular solution for transferring and positioning large-scale hardware and materials in a factory is needed.

Figure 2:
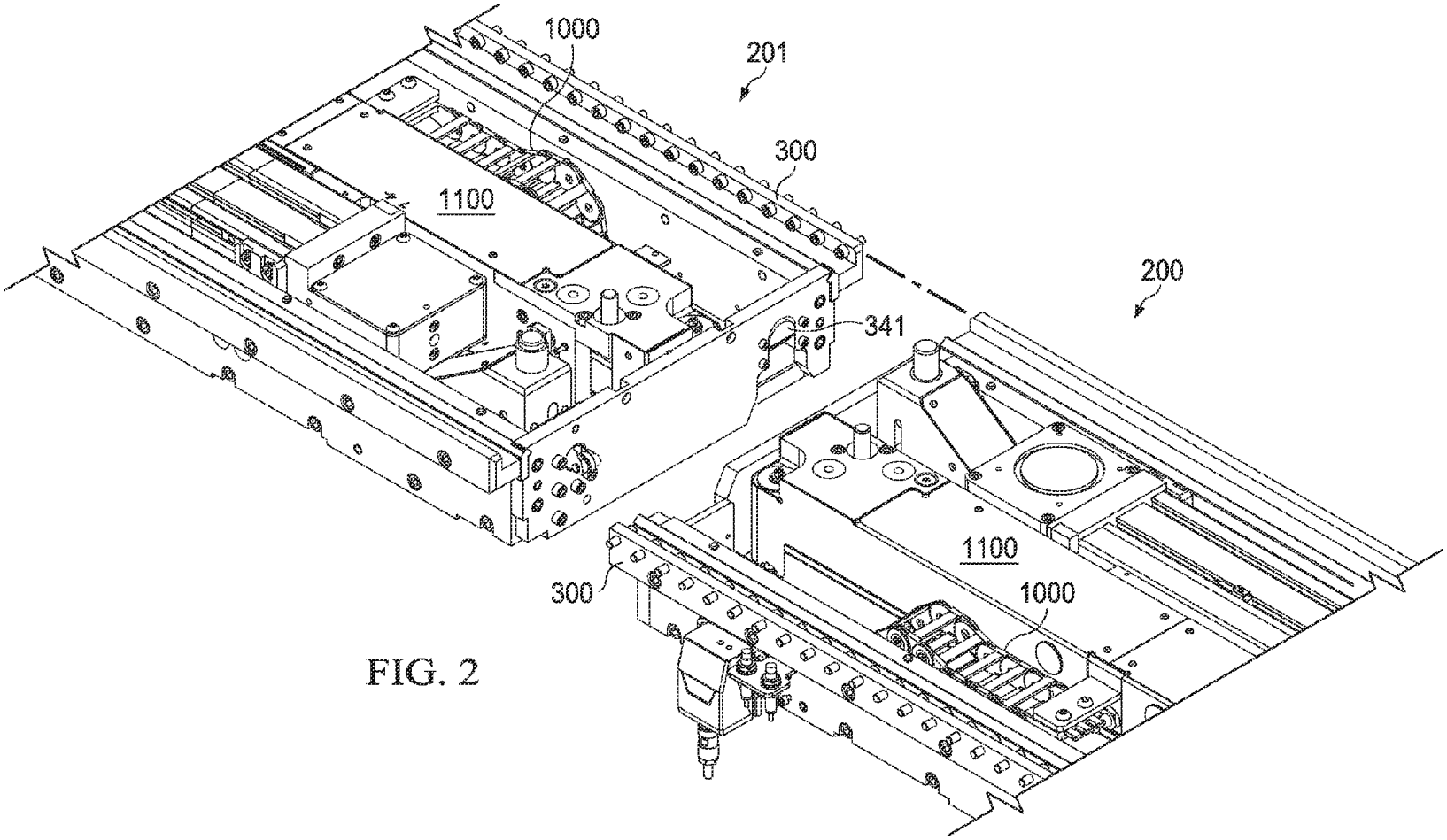
FIG. 2 illustrates two automated transfer and positioning systems for large-scale hardware with ends disposed in close proximity to each other according to embodiments of the present disclosure.

FIGS. 1 and 2 illustrate automated transfer and positioning systems 100, 200, and 201 for large-scale hardware according to embodiments of the present disclosure. FIG. 1 illustrates the automated transfer and positioning system 100 for large-scale hardware according to embodiments of the present disclosure. The automated transfer and positioning systems 100 for large-scale hardware provide an automated, modular solution for transferring and positioning large-scale hardware and materials in a factory. The automated transfer and positioning system 100 eliminates critical lifting and manual movement from the process of moving large-scale hardware to various assembly stations within an industrial facility. The automated transfer and positioning system 100 provides an automated transfer of large-scale hardware from an assembly work station (WS) onto an automated guided vehicle (AGV) and onto an assembly work station in a different location.

Although certain details will be provided with reference to the components of the automated transfer and positioning system 100 for large-scale hardware, it should be understood that other embodiments may include more, less, or different components. The automated transfer and positioning system 100 includes a standard factory rail 300 (also referred to as "common factory rail" or "common rail" or "CFR") and a cradle drive system ("CDS") 1000, which includes a cradle drive sled 1100. The automated transfer and positioning system 100 includes one or more hardware cradles 1300. Further details about the components 300, 1000, 1100, and 1300 of the automated transfer and positioning system 100 are provided with reference to the figures below.

Although the present disclosure includes examples of the automated transfer and positioning system 100 being used for missile related functions, the system 100 is not limited missile related functions, and can be used to transfer, translate, or position other large-scale hardware, including: composites, molds, factory dies, fabrication shop jigs and fixtures, aircraft assemblies, spacecraft assemblies, section subassemblies, test equipment, and components of subassemblies. The automated transfer and positioning system 100 can be used for positioning patients in a mechanism, such as a magnetic resonance imaging (MRI) machine or a computed tomography (CT) scanner.

Figure 17:
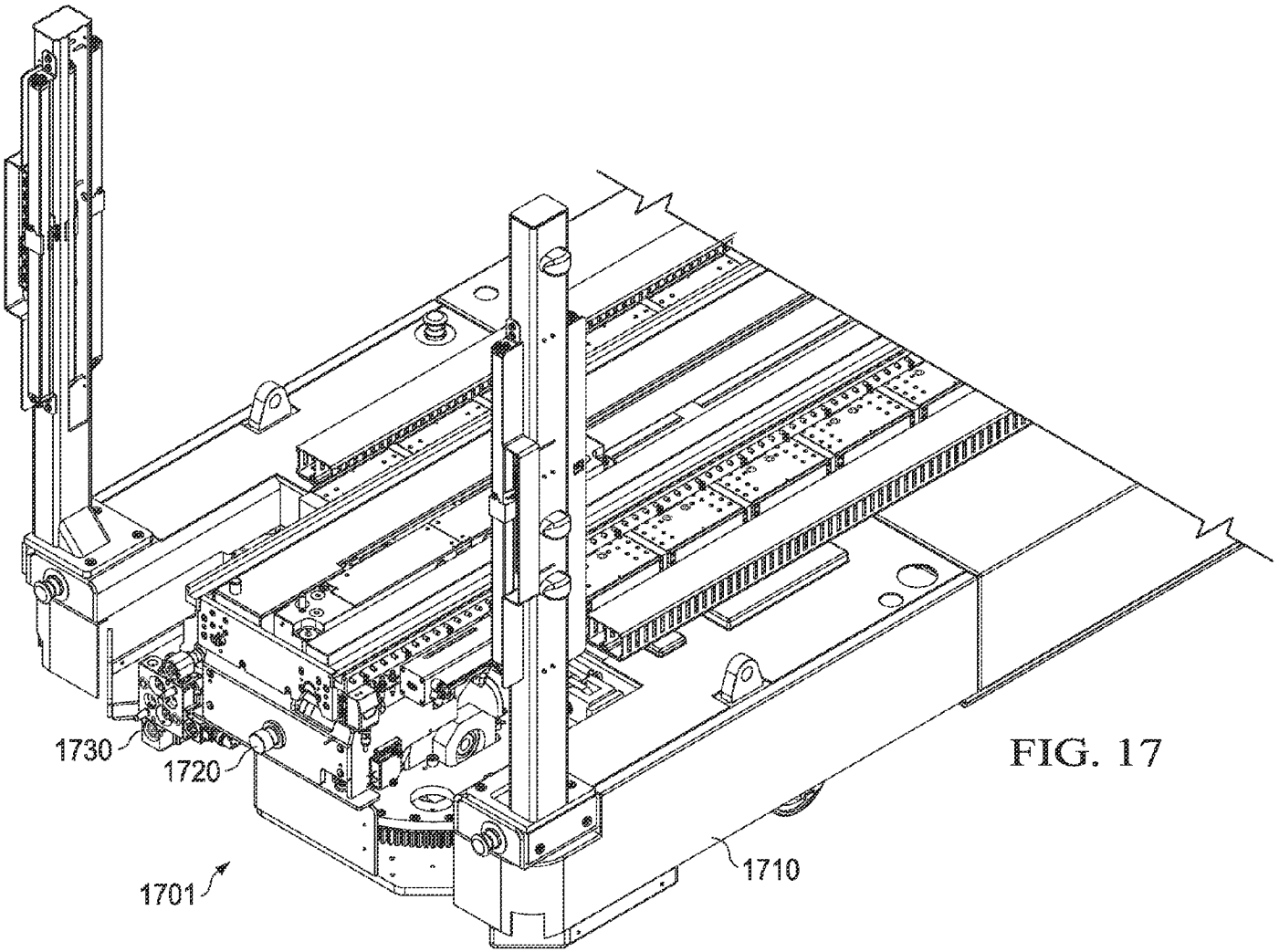
FIG. 17 illustrates an automated guided vehicle automated transfer and positioning system for large-scale hardware integrated with an automated guided vehicle according to embodiments of the present disclosure.
Figure 18:
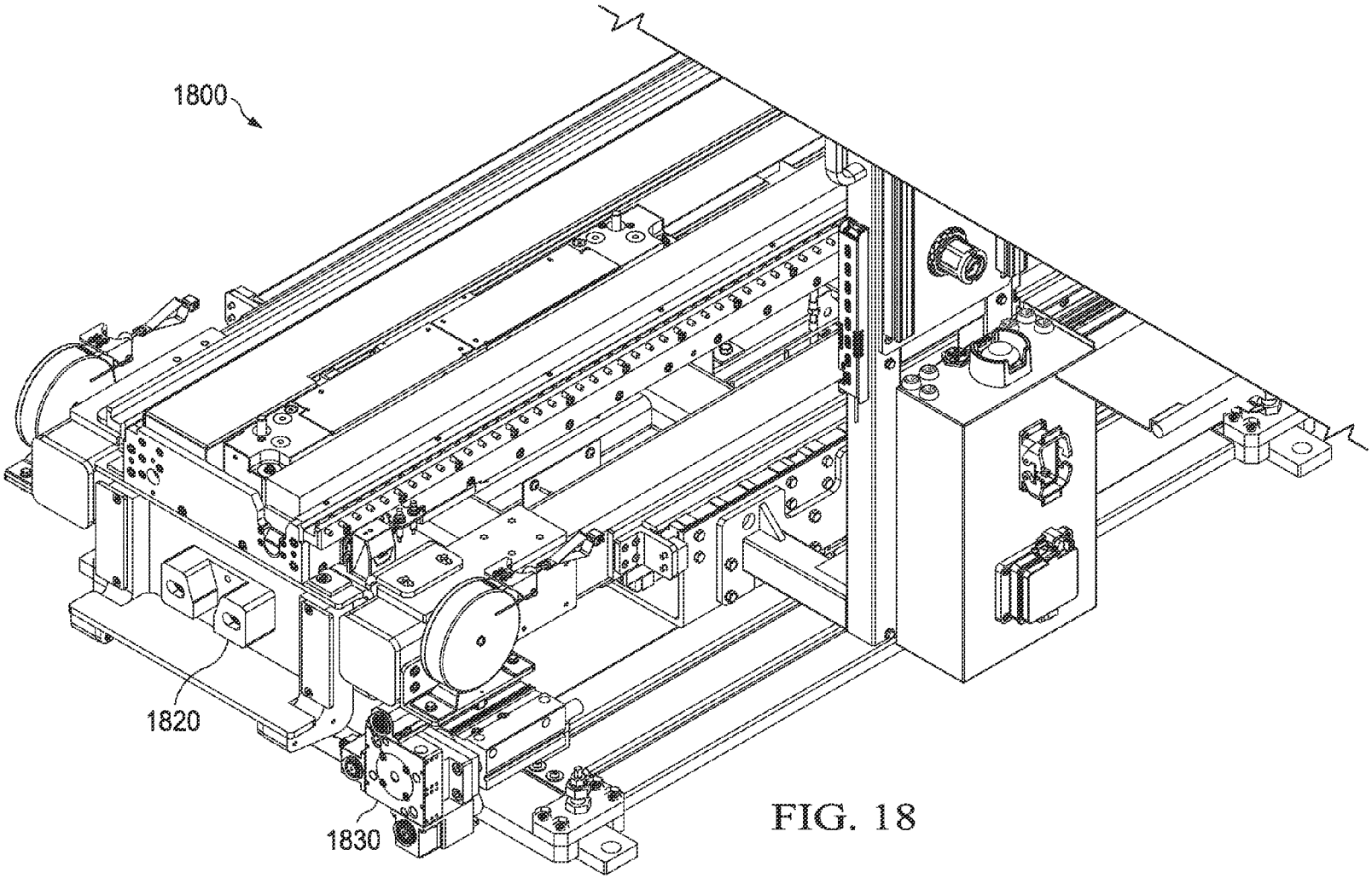
FIG. 18 illustrates an assembly work station automated transfer and positioning system for large-scale hardware according to embodiments of the present disclosure.

FIG. 2 illustrates two automated transfer and positioning systems 200, 201 for large-scale hardware with ends disposed in close proximity to each other according to embodiments of the present disclosure. More particularly, FIG. 2 illustrates a perspective view of a stationary assembly work station automated transfer and positioning system in close proximity to an automated transfer and positioning system of an AGV. Some sheet metal covers are hidden for clarity. A zero-lift hardware transfer method can be implemented at any location where a common rail 300 is installed. In order to implement a zero-lift hardware transfer, the AGV's automated transfer and positioning systems 201 (also referred to as "AGV system") docks with the stationary WS automated transfer and positioning system 200 (also referred to as "WS system"). That is, the AGV drives into close proximity to an assembly work station. The deck of the AGV includes hydraulics that, when the AGV reaches a selected distance away from the assembly work station, lowers the AGV's common rail onto a load-supporting shelf of the stationary assembly work station. The docking assemblies (as shown in FIGS. 17 and 18) cause the common factory rails of the WS system 200 and the AGV system 201 to center with each other. That is, the dual vee rails align with each other.

Figure 3A:
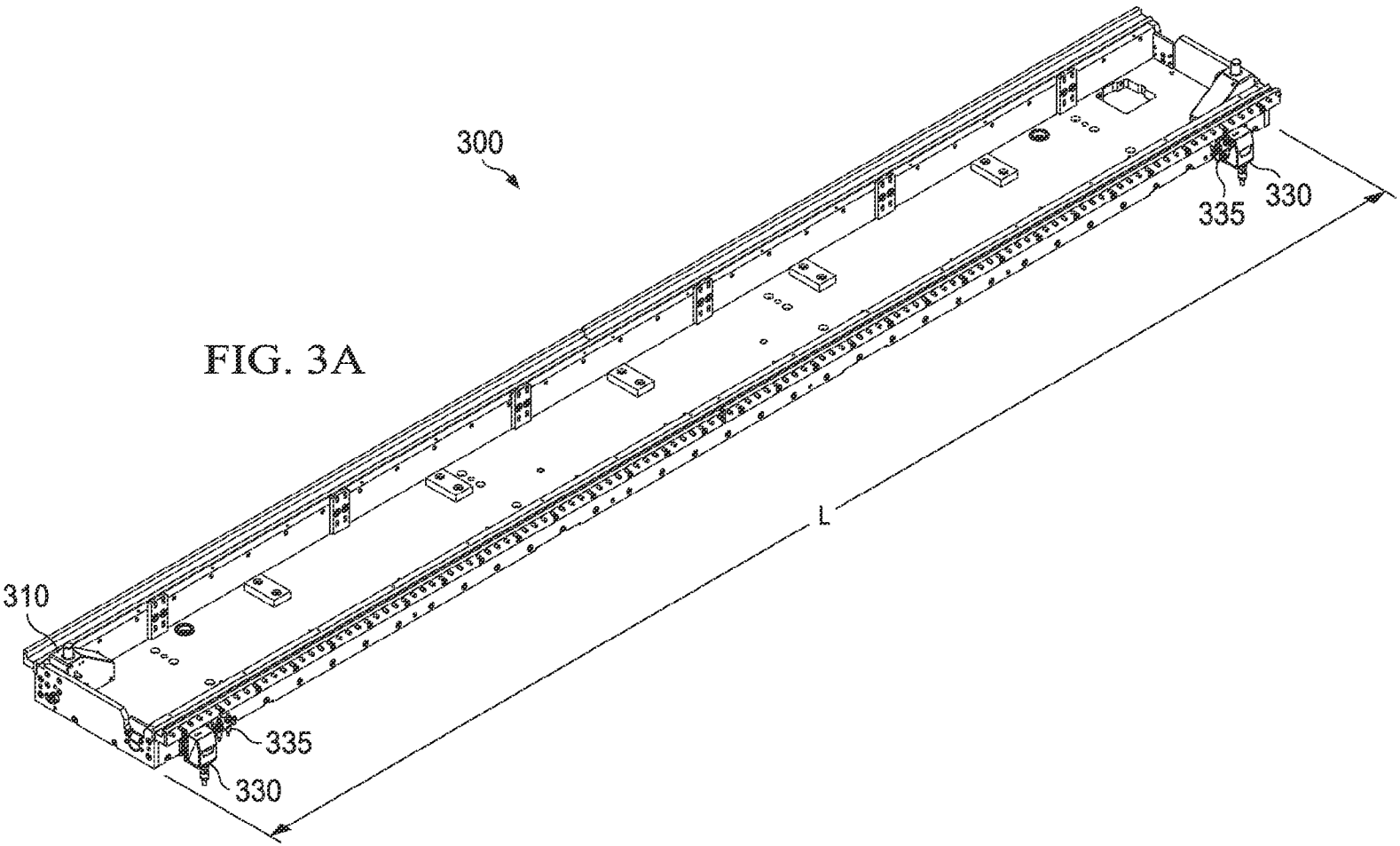
FIG. 3 illustrates a common factory rail according to embodiments of the present disclosure.
Figure 3B:
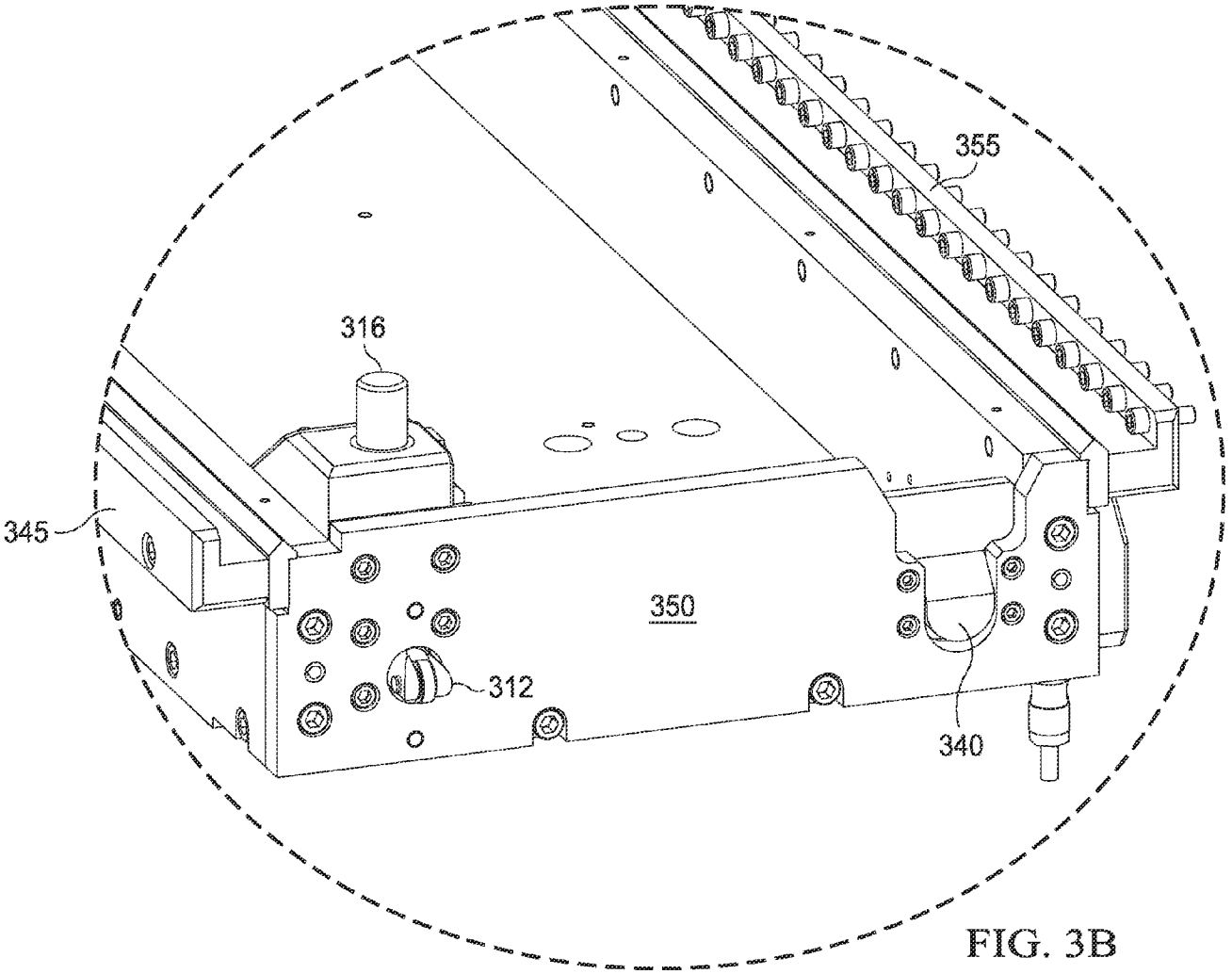

FIG. 3 illustrates a common factory rail 300 according to embodiments of the present disclosure. Although certain details will be provided with reference to the components of the common factory rail 300, it should be understood that other embodiments may include more, less, or different components.

The factory rail 300 is a common mechanical interface to cradles, and each cradle includes an interface configured to couple to large-scale hardware, such as a missile or an encanistered missile. That is, each cradle is configured to mechanically couple to the common rail in order to move along the rail. The factory rail 300 supports the weight load of the hardware (not shown) and integrates features that allow the cradles, and therefore the large-scale hardware, to translate longitudinally along the common rail 300. For example, the hardware cradles 1300 translate longitudinally in the direction of the arrow L. The factory rail 300 also supports the load from canister cradles, parts presentation vehicles (PPVs), and fixture presentation vehicles (FPVs), each of which is configured to mechanically couple to the common rail 300.

In certain factories, the common rail 300 is installed throughout the factory, at every stationary assembly work station, at every encaninsterization-decanisterization station, within test cells, and on every AGV. In certain embodiments, the common rail includes only one track of common rail. In certain embodiments, the common rail 300 includes multiple track sections of various lengths, such as 9 feet, 10 feet, 19 feet, 24 feet, and 48 feet. That is, the common rail 300 can include any number of track sections extending to any length. AGVs of various sizes include tracks of an appropriate length—a length proportional to the surface size of the AGV.

The factory rail 300 includes an end stop assembly 310 at each end of each track of the rail. Each end stop assembly includes an end stop pin 316. The end stop assembly 310 prevents a cradle from sliding off the end of the factory rail 300. The end stop pin 316 is a safety feature that indicates whether two systems 100 are separated or docked together at the end corresponding to the end stop assembly (namely, the end of the common rail where the end stop pin 316 is disposed). As described in further details below with reference to FIGS. 4 and 5, end stop pin 316 retracts when an end stop end 312 is pushed upon.

The factory rail 300 includes two or more barcode readers 330. The barcode reader 330 is configured to read the barcode or quick-response (QR) code of a cradle brake plate that enters onto that specific track of the factory rail 300. The barcode reader 330 determines the type of cradle, orientation, and serial number of the cradle.

A proximity sensor 335 of the factory rail 300, such as a trigger sensor, is coupled to each end of the factory rail 300. In certain embodiments, the proximity sensor 335 comprises a Turck proximity sensor that senses a cradle retaining plate on the common rail 300, and in response, triggers the barcode reader to read a barcode.

The ends of the factory rail 300 are configured to dock with an end of another factory rail 300. For example, the factory rail 300 of a stationary work station (also referred to as "WS rail") is configured to dock or physically couple with the factory rail 300 of an AGV (also referred to as "AGV rail"). The end of the WS rail 300 includes an adjustable interface 340 configured to actuate an end stop end 312 of the end stop assembly 310 of the AGV rail. Similarly, the end of the AGV rail 300 includes an adjustable interface 341 configured to actuate the end stop end 312 of the WS rail. The actuation of the end stop end 312 causes the end stop pin 316 to lower or recess. The end stop pin 316 is protracted when the end stop end 312 is not actuated.

The common factory rail 300 includes several components used while translating cradles longitudinally: a Bishop Wisecarver Dualvee rail along both sides of the common rail 300; an aluminum friction surface 345 for manual cradle brake is disposed along both sides of the common rail 300; an end plate 350 on each end of the common rail 300; SHCS and dowel spacing (eighteen having a size of 5/16 inches), an socket head cap screw (SHCS) interface 355 (for example, a rack or array of small protrusions) along one side of the common rail 300 for a cradle gear; and at least two flanges and web composed from metal, such as steel. In certain embodiments, the SHCS and dowel spacing varies based on a length of the common rail 300.

Figure 4A:
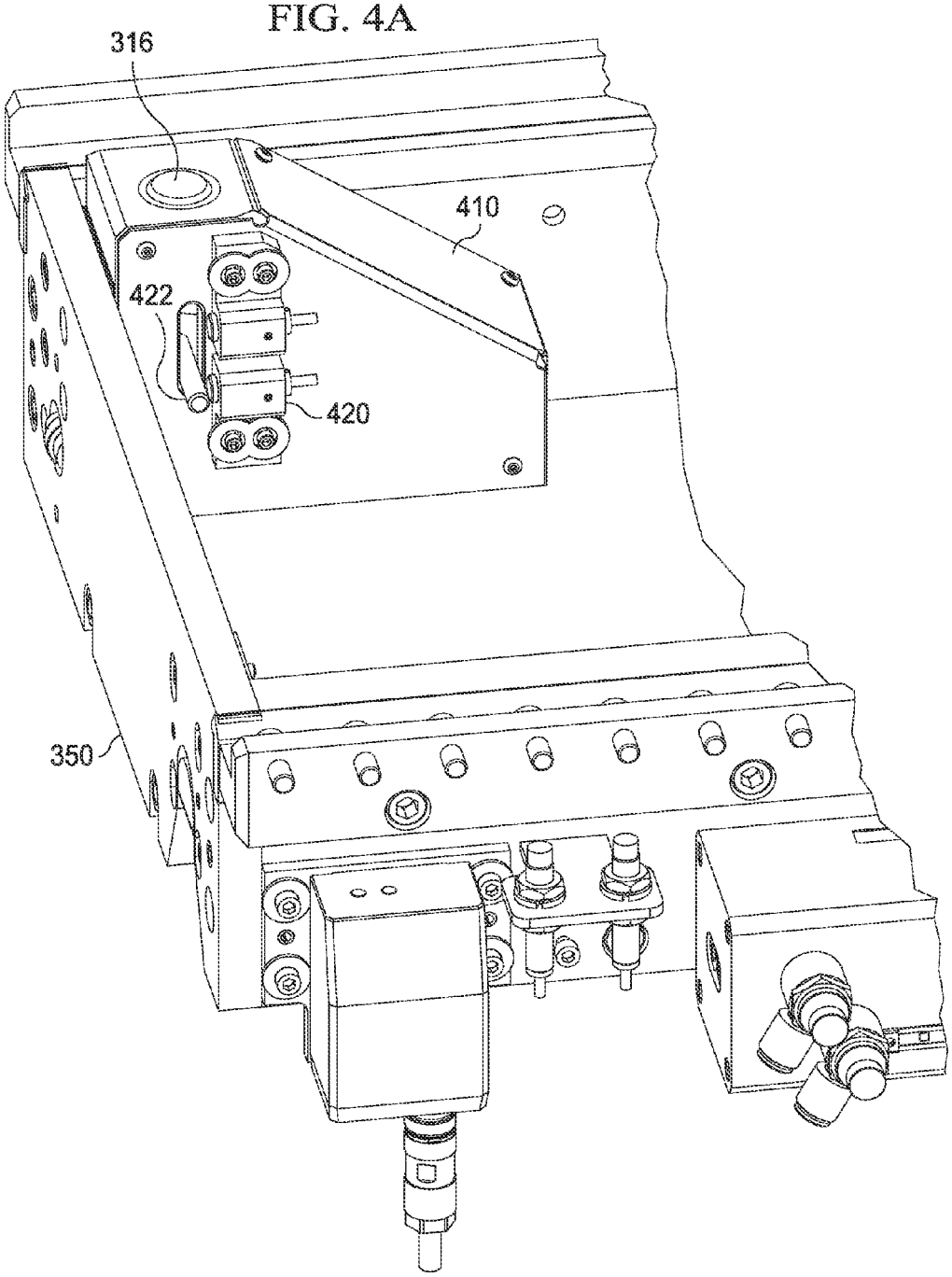
FIGS. 4A and 4B illustrate an end stop pin of the common factory rail of FIG. 3.
Figure 4B:
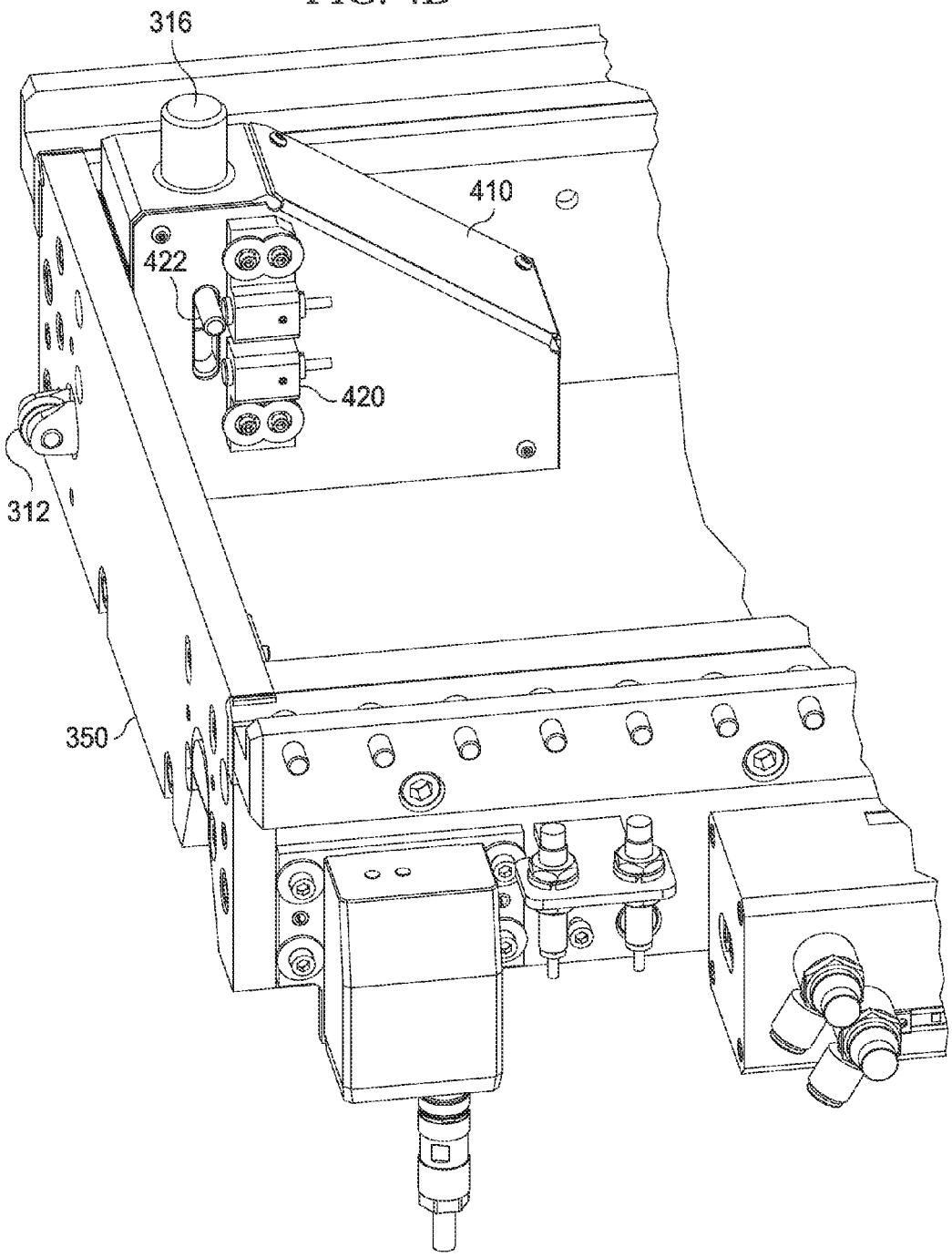
Figure 5:
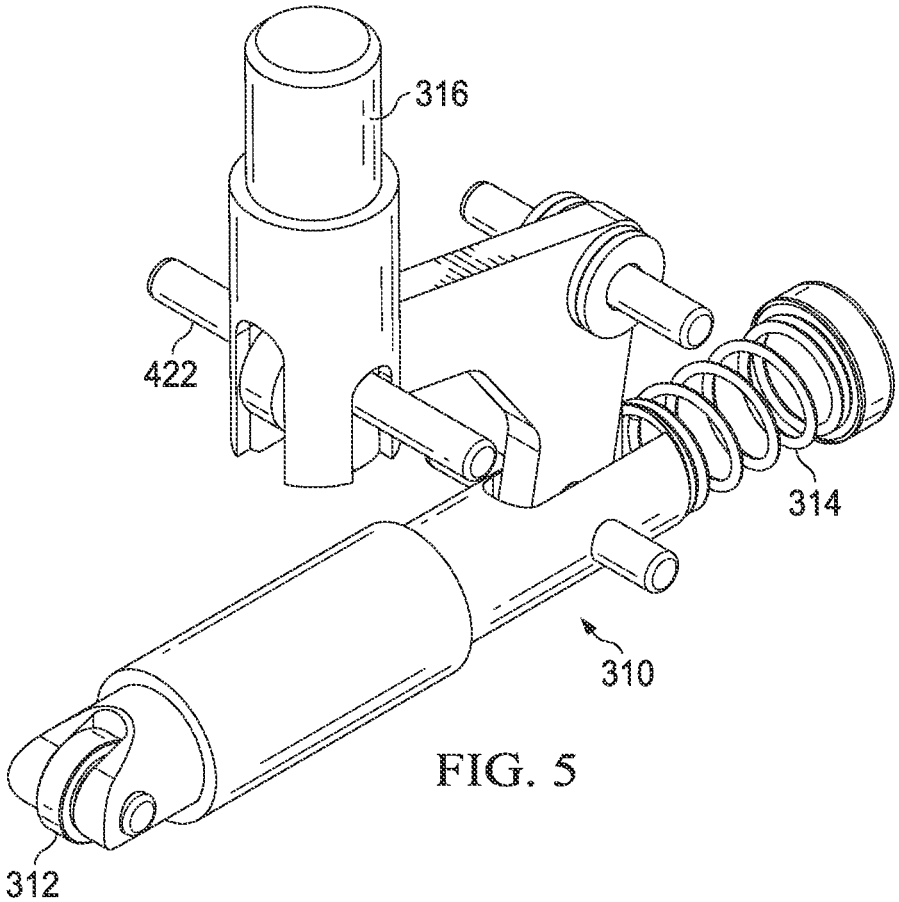
FIG. 5 illustrates the end stop pin of FIGS. 4A and 4B with the housing hidden.

FIGS. 4A and 4B illustrate an end stop assembly 310 of the common factory rail of FIG. 3 within a housing 410. FIG. 5 illustrates the end stop assembly 310 of FIGS. 4A and 4B without the housing 410. Referring to FIGS. 4A, 4B, and 5, the end stop pin 316 is included within the end stop assembly 310 of the common rail 300. The end stop assembly 310 is contained within the housing 410 that completely encloses the end stop pin 316 when retracted. The end stop assembly pin 316 prevents a cradle from sliding off the end of the factory rail 300 when protracted. When the AGV rail 300 is docked, the AGV adjustable interface 341 pushes against an end stop end 312 of the WS end stop assembly 310. At the same time, the WS adjustable interface 340 pushes against an end stop end 312 of the AGV end stop assembly 310. The force pushing on the end stop ends 312 compresses the end stop pin spring 314 and causes the end stop pin 316 to recess below the top surface of the housing 410. When the factory rail 300 is not docked, the end stop pin 316 raises and extends above the top surface of the housing 410, preventing a cradle from passing the end plate 350 and from slipping off the end of the factory rail 300.

In certain embodiments, the end stop assembly 310 includes a sensor 420 that detects whether the end stop pin 316 is recessed. As shown in FIG. 4B, when the end stop pin 316 is raised, a lever 422 of the end stop pin 316 is in a high position and engages with an upper portion of the sensor 420. In response to the engagement of the lever 422 and the upper portion of the sensor 420, the sensor 420 sends a protracted-end-stop-pin indication to a controller within the AGV system 100. As shown in FIG. 4A, when the end stop pin 316 is retracted, the lever 422 of the end stop pin 316 is in a low position and engages with a lower portion of the sensor 420. In response to the engagement of the lever 422 and the lower portion of the sensor 420, the sensor 420 sends a recessed-end-stop-pin indication to a controller within the AGV system 100. The controller within the AGV and WS system 100 uses the recessed-end-stop-pin sensor indication to trigger a fault condition that stops the AGV from driving and stops CDS sled 1100 movement when the AGV is undocked and the end stop pin is recessed. The fault condition prevents a cradle from slipping off the AGV factory rail.

Figure 6:
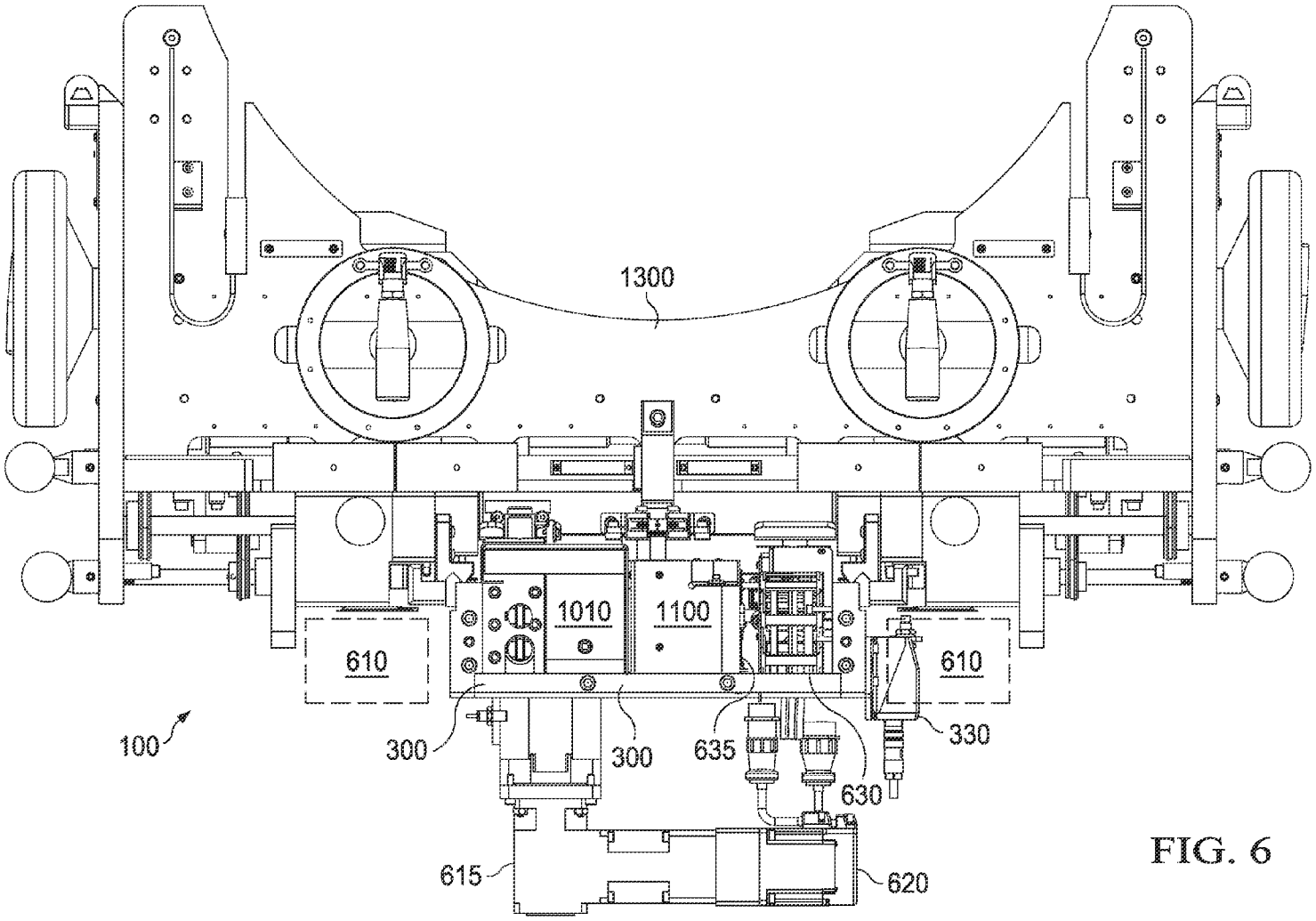
FIG. 6 illustrates a front view of the automated transfer and positioning system for large-scale hardware of FIG. 1.

FIG. 6 illustrates a front view of the automated transfer and positioning system 100 for large-scale hardware of FIG. 1. The sheet metal that covers the internal components of the automated transfer and positioning system 100 is hidden for clarity. The automated transfer and positioning system 100 includes the common rail system 300, the cradle drive system 1000 that includes a CDS sled 1100. The hardware cradle 1300 is partially shown—a top portion of the cradle is not shown in FIG. 6.

When the AGV includes the automated transfer and positioning system 100, the cradle drive system includes an automated AGV cradle brake 610. The automated AGV cradle brake 610 is not shown in FIG. 6, but the location of the brake 610 on each side of the common rail 300 is shown. The automated AGV cradle brake 610 stops the cradle from moving, especially while the AGV is in motion or detached from an assembly work station.

Figure 10:
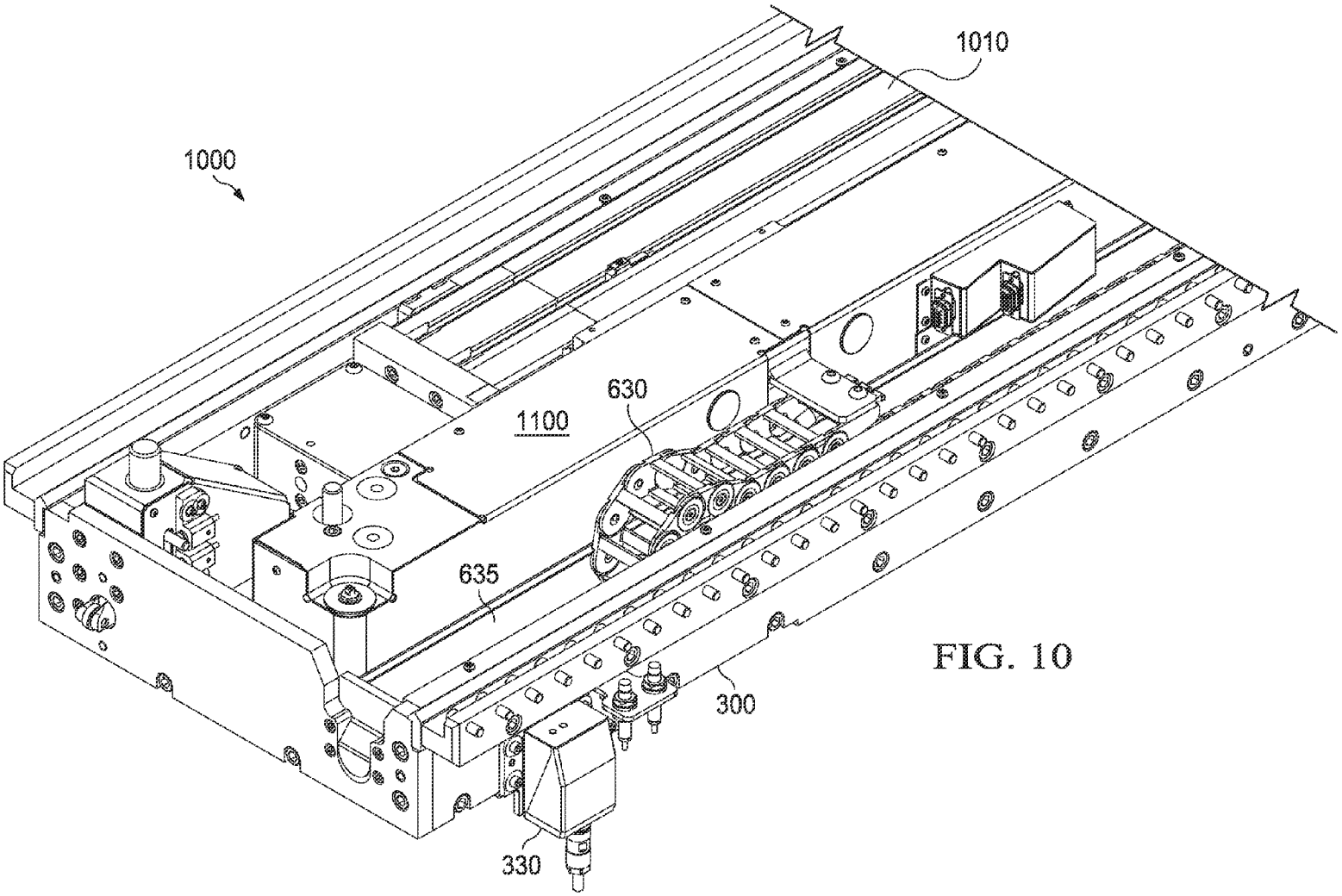
FIG. 10 illustrates a cradle drive system according to embodiments of the present disclosure.

FIGS. 6 and 10 refer to the cradle drive system 1000. FIG. 10 illustrates a cradle drive system 1000 according to embodiments of the present disclosure. The CDS 1000 is integrated within the common rail 300 and provides the torque and power to move the hardware. For example, a CDS 1000 is integrated within every common rail 300 of a factory, including on WSs and AGVs. The CDS 1000 pushes or pulls hardware cradles, canister cradles, PPVs, FPVs along the common rail 300. Although certain details will be provided with reference to the components of the CDS 1000, it should be understood that other embodiments may include more, less, or different components. The CDS 1000 includes a drive assembly, a belt drive system, a slip coupling, and the CDS sled 1100. The CDS 1000 is primarily disposed within the confines of the common rail system 300, and certain components are disposed beneath the common rail 300.

Figure 7:
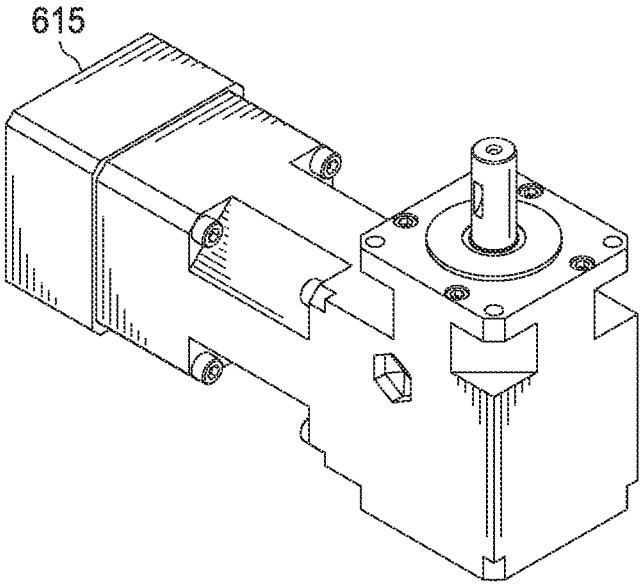
FIG. 7 illustrates a gear box of the automated transfer and positioning system for large-scale hardware of FIG. 1.

The CDS belt drive system includes a belt drive linear actuator 1010, such as a Tolomatic belt drive linear actuator. The CDS belt drive system includes a gearbox 615, disposed below the common rail 300. More particularly, FIG. 7 illustrates a gear box 615 of the automated transfer and positioning system 100 for large-scale hardware of FIG. 1. For example, the gearbox 615 can include a CGI 28:1 right angle gearbox. The gearbox 615 is coupled, such as by attachment, to a belt drive-to-gearbox adapter.

The slip coupling is disposed between the belt drive and the gearbox 615. In certain embodiments, the slip coupling comprises an integral slip clutch that, in an overload condition, prevents damage to the belt drive system and hardware loaded onto the cradle. In certain embodiments, the slip coupling includes a slip coupling proximity sensor and an adjustable bracket. In the event that the CDS sled 1100 causes hardware to collide by translating a first loaded cradle too close to second loaded cradle, the slip clutch triggers the CDS sled 1100 to stop translating the first loaded cradle. The cradle drive system includes error proofing sensors to prevent collisions.

Figure 8:
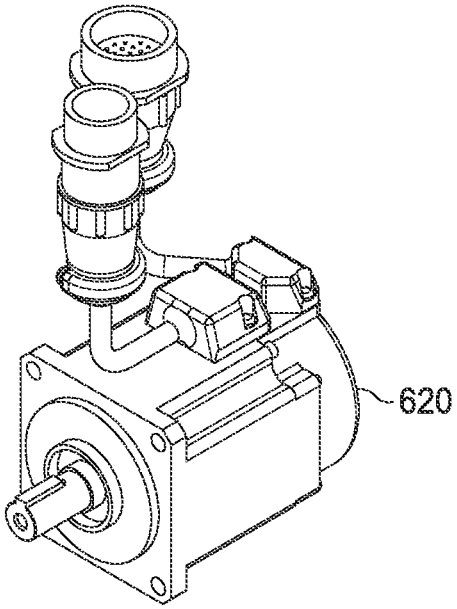
FIG. 8 illustrates a servomotor of the automated transfer and positioning system for large-scale hardware of FIG. 1.

The CDS drive assembly includes a servomotor 620. More particularly, FIG. 8 illustrates a servomotor 620 of the automated transfer and positioning system 100 for large-scale hardware of FIG. 1.

Figure 9:
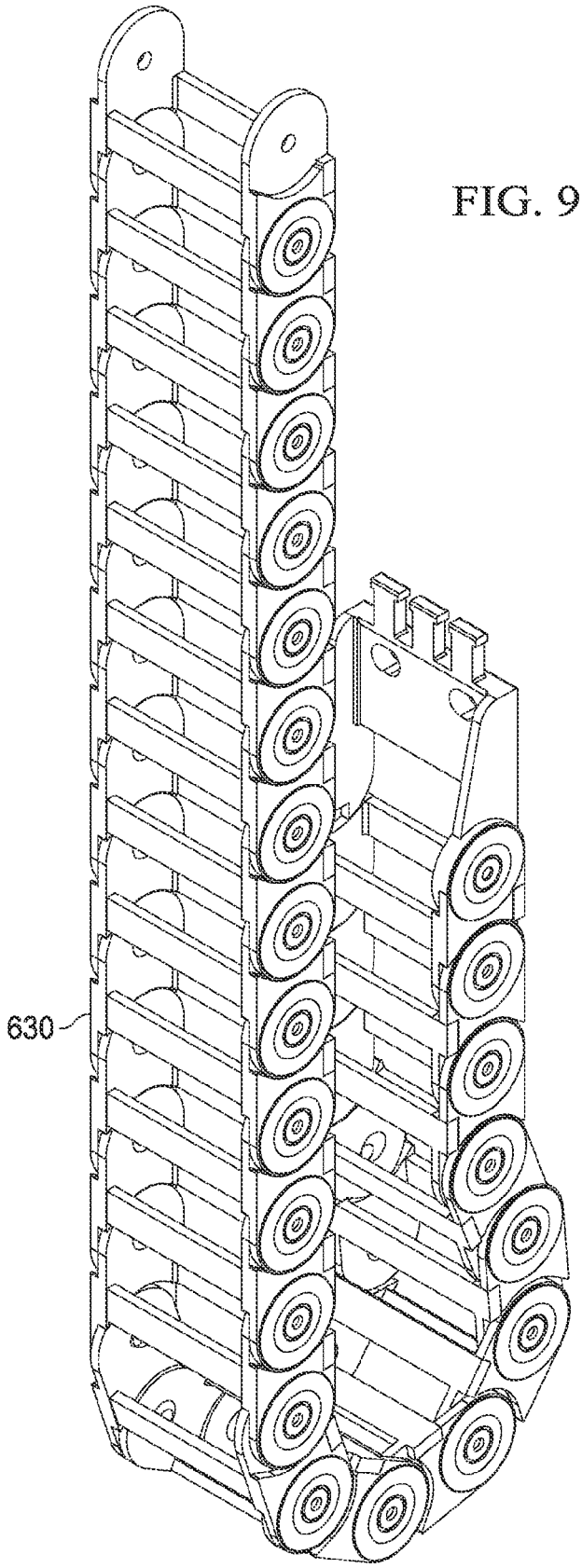
FIG. 9 illustrates a cable chain of the automated transfer and positioning system for large-scale hardware of FIG. 1.

The CDS 1000 includes a cable chain 630 and a cable chain guide 635 that guides the cable chain 630. In certain embodiments, the cable chain guide 635 is composed from sheet metal. FIG. 9 illustrates a cable chain 630 of the automated transfer and positioning system 100 for large-scale hardware of FIG. 1. In certain embodiments, the cable chain includes an electrostatic discharge (ESD) cable chain, such as an ESD Igus E-chain for routing high flex power or signals through cables and pneumatic lines.

Figure 11:
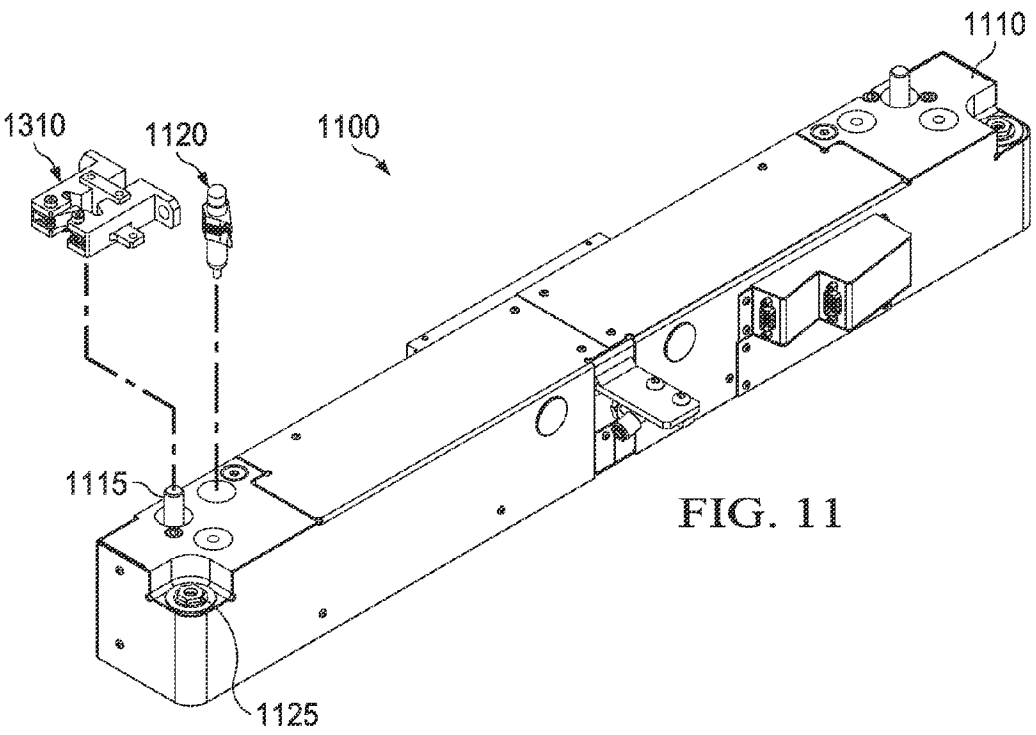
FIG. 11 illustrates a cradle drive sled according to embodiments of the present disclosure.

FIG. 11 illustrates a cradle drive system sled 1100 according to embodiments of the present disclosure. The CDS sled 1100 is a component of the cradle drive system 1000. The CDS sled is an intelligent modular device that transfers power and torque from the cradle drive system 1000 to the cradles coupled to the common rail system 300. That is, the CDS sled 1100 provides the torque and power to move the hardware by pulling or pushing hardware cradles 1300. More particularly, the CDS sled 1100 applies the torque and power required for translation and transfer of the hardware along the common rail 300. For example, the CDS sled 1100 incorporates a sensor bank assembly 1110 that includes an interface 1115 configured to couple to the hardware cradle 1300 in order to transfer the torque. The CDS sled 1100 is capable of translating the full distance of the length of the common rail 300. More particularly, when coupled to a loaded hardware cradle 1300 (hardware load not shown), the CDS sled 1100 is capable of supplying the energy required to cause a hardware cradle 1300 (including the hardware loaded thereunto) to translate the full distance of the length of the common rail 300. Although certain details will be provided with reference to the components of the CDS sled 1100, it should be understood that other embodiments may include more, less, or different components.

A controller provides intelligence to the CDS sled 1100. In certain embodiments, the controller is included within the system 100, such as the WS system 200. In other embodiments, the controller is integrated into the automated transfer and positioning system 100 coupled to the CDS sled 1100. The controller performs certain functions of the CDS sled 1100. In certain embodiments, the controller includes executable instructions stored in a machine-usable, computer-usable, or computer-readable medium in any of a variety of forms, wherein the instructions cause the processing circuitry to perform a mapping sequence method or a zero-lift hardware transfer method. In certain embodiments, the controller includes a memory. The memory may include any suitable volatile or non-volatile storage and retrieval device(s). For example, the memory can include any electronic, magnetic, electromagnetic, optical, electro-optical, electro-mechanical, or other physical device that can contain, store, communicate, propagate, or transmit information. The memory can store data and instructions for use by the controller cause processing circuitry to execute the instructions.

Figure 12:
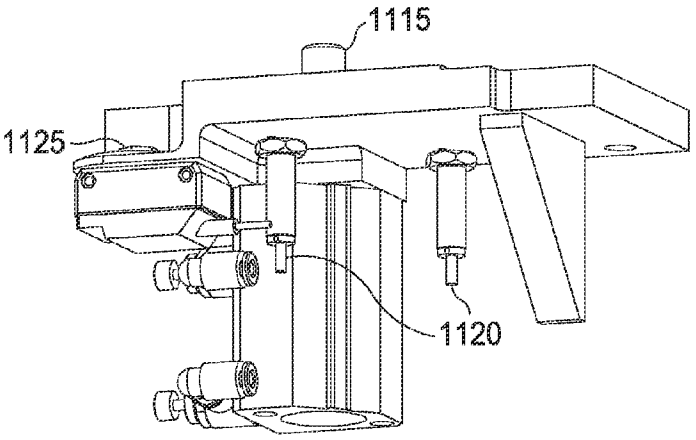
FIG. 12 illustrates a sensor bank assembly of a cradle drive sled according to embodiments of the present disclosure.

The CDS sled 1100 includes a sensor bank assembly 1110 on each end of the sled. FIG. 12 illustrates a sensor bank assembly 1110 of a cradle drive sled 1100 according to embodiments of the present disclosure. Although certain details will be provided with reference to the components of the sensor bank assembly 1110, it should be understood that other embodiments may include more, less, or different components. The sensor bank assembly 1110 also includes pneumatic pins 1115 configured to be captured within a spring loaded capture clip 1310 of the hardware cradle 1300. In certain embodiments, the pin 1115 includes a pneumatic cylinder that, when extended, raises up above the top surface of the CDS sled's 1100 sheet metal housing. The pin 1115 is capable of lowering to recess below the top surface of the CDS sled.

The sensor bank assembly 1110 includes two or more proximity sensors 1120 that sense in a vertically upward direction (namely, in the direction of the arrow VU). A first proximity sensor 1120 detects the presence of a cradle coupled to the common rail 300.

A second proximity sensor 1120 determines engagement of the pin 1115 into a cradle's capture clip 1310. Another sensor within the pin 1115 pneumatic cylinder indicates whether the pin 115 is extended or recessed. When the pin 1115 is extended, the second proximity sensor 1120 detects alignment of the pin 1115 with the capture clip 1310 to determine whether the CDS sled 1100 is in the correct position for moving the cradle associated with the capture clip 1310. Based on the extended-pin signal and the alignment of the CDS sled 1100 with the cradle into the correct position, and the second proximity sensor 1120 signal that indicates the CDS sled 1100 is mechanically coupled to the cradle, and the retro-reflective sensor 1125 indicating satisfactory manual cradle brake and ring roll brake conditions, the cradle drive system deduces that the CDS sled 1100 is ready to begin moving the cradle.

The sensor bank assembly 1110 includes a polarized retro-reflective sensor 1125 that detects the engagement status of the manual cradle brake. When the sensor 1125 detects that the manual cradle brake or ring roll brake is engaged, the CDS sled 1100 sends a signal to a controller to alarm a user that the detected cradle should not be moved while the manual cradle brake is in an engaged status. The alarm associated with the engaged manual cradle brake prompts the user to disengage the manual cradle brake before attempting to move the cradle. The retro-reflective sensor 1125 also detects engagement of the ring roll brake of the hardware cradle 1300. The ring roll brake of the hardware cradle is described below in reference to FIG. 13A.

Other components of the CDS sled 1100 include: a cable chain bracket coupled to the cable chain 630; a pneumatic supply connection; a power and signal connection configured to receive electricity and signals to provide intelligence (for example, an instruction or a command) to move hardware loads; a via (also referred to as "access for removal") configured for to receive an object to remove the CDS sled 1100 from the common rail 300; a pneumatic stopper cylinder; solenoid valves; supply tubing; a sled frame providing structural stability for the components of the CDS sled; and sheet metal covers. Movement of the CDS sled 1100 causes the cable chain 630 to move. Movement of the CDS sled 1100 causes the cable chain 630 to move.

As a specific non-limiting example, a user selects a hardware item to be moved from a WS rail to a test cell located 500 feet away through a corridor. The user selection may include a type of hardware component, assembly, or subassembly (namely, a group of identifiers corresponding to the type of hardware selected). The user selection may include a specific identifier (e.g., barcode or QR code) corresponding to a specific hardware component, assembly, or subassembly. In response to receiving the user selection, the WS CDS sled 1100, moves to a first end of the WS rail 300. While the CDS sled 1100 translates an entire length of the factory rail, the CDS sled 1100 reads the identifiers of each cradle coupled to the common rails 300, looking for an identifier that matches the user selection. Upon determining that a the equipment of a cradle on the factory rail 300 matches the user selection, the CDS sled 1100 sends a signal to a user computer indicating that the selected equipment is located on the factory rail. Upon determining that none of the equipment of the cradle on the factory rail matches the user selection, the CDS sled 1100 sends a signal to a user computer indicating that the selected equipment is not located on the factory rail.

Figure 13A:
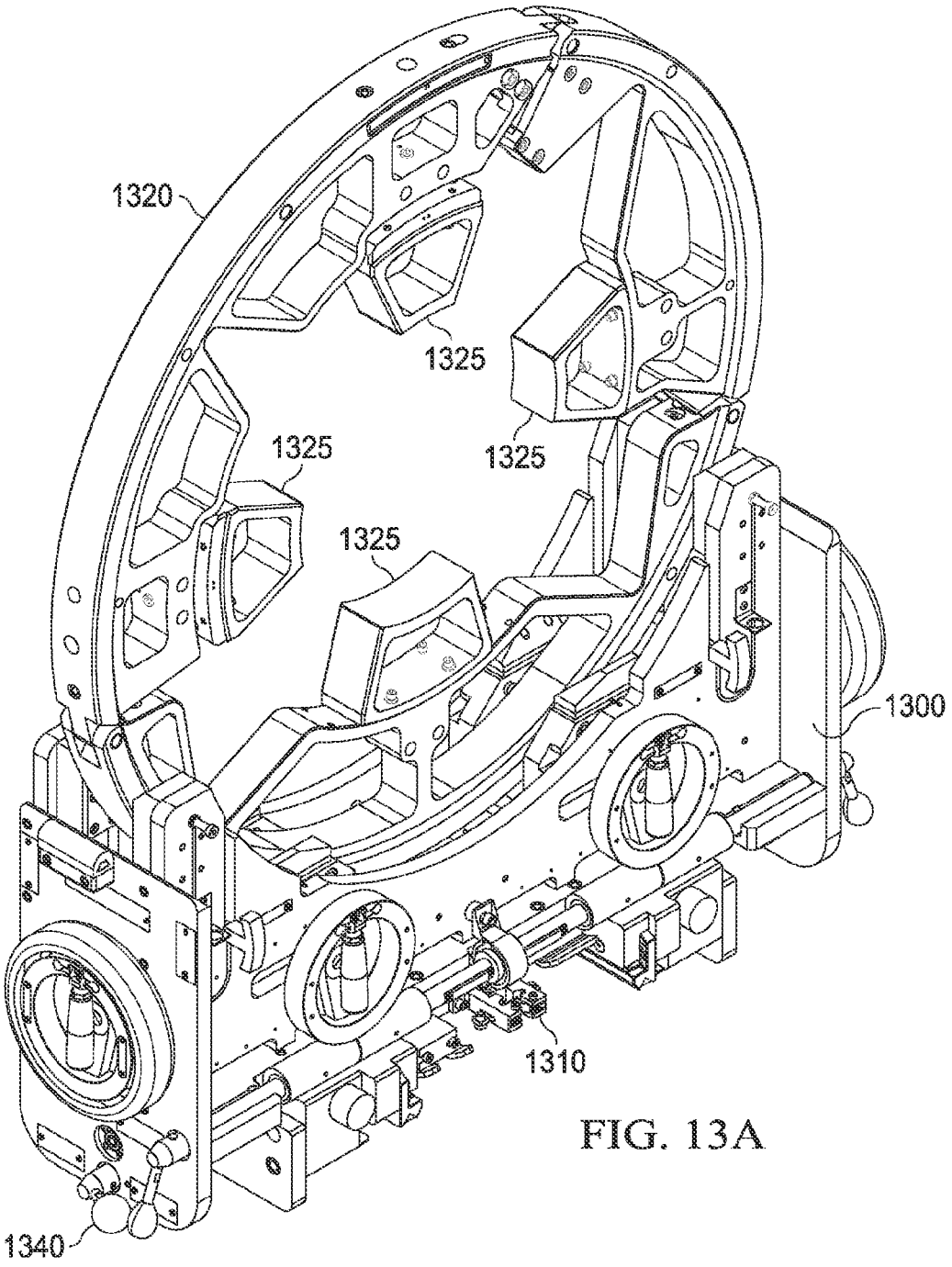
FIGS. 13A and 13B illustrate various cradles according to embodiments of the present disclosure.
Figure 13B:
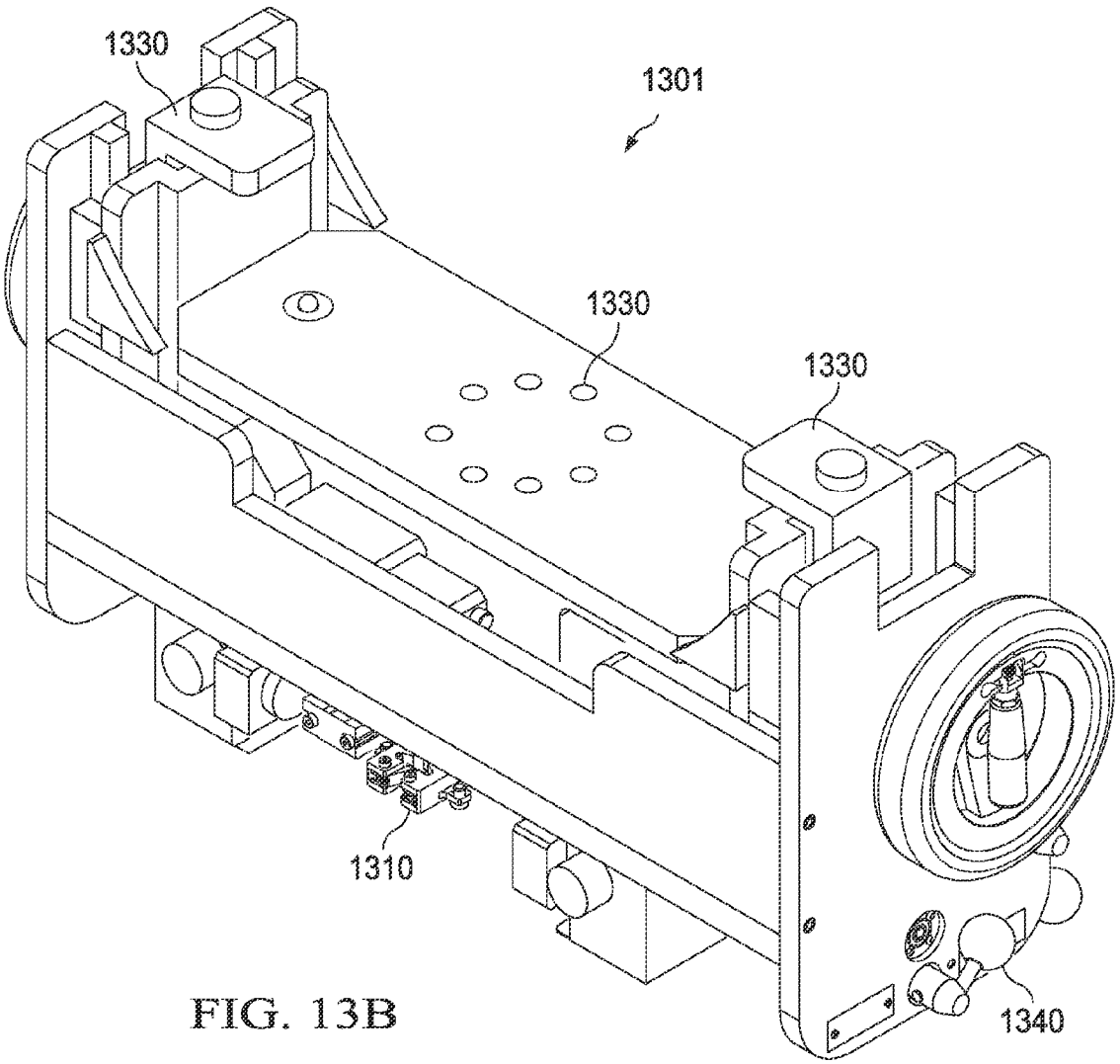

FIGS. 13A and 13B illustrate various cradles according to embodiments of the present disclosure. FIG. 13A illustrates a hardware cradle 1300 coupled to a hardware ring 1320. The hardware ring 1320 includes an interface 1325 configured to couple to a large-scale hardware cylinder (not shown), such as a missile. The hardware cradle 1300 includes a ring roll brake, such as a friction brake. The ring roll brake stops the hardware ring from rotating or rolling in the hardware cradle 1300. FIG. 13B illustrates a hardware cradle 1301 configured to couple to a rectangular canister. The hardware cradle 1301 includes a rectangular interface 1330 configured to couple to a rectangular canister, such as an encanistered missile.

Although certain details will be provided with reference to the components of the cradles 1300 and 1301, it should be understood that other embodiments may include more, less, or different components. Also, it should be understood that other embodiments may include different shapes, configured to couple to various shaped hardware rings 1320, canisters, or other large-scale hardware. For example, a PPV is a cradle that holds various piece parts, fasteners, or other types of hardware. Each cradle 1300-1301 includes a manual cradle brake 1340, such as a friction brake. To engage or disengage the manual cradle brake 1340, a user manually turns a cradle brake handle that causes the manual cradle brake 1340 to engage with the aluminum friction surface 345 of the common rail 300. The cradle brake prevents the cradle 1300-1301 from moving.

Using user-input data and information from the barcode reader 330 indicating the type of cradle and orientation, the controller can determine the type, size, or shape of the hardware load and prevent the CDS sled 1100 from moving a second loaded cradle too close to a first loaded cradle, thereby preventing a collision of protruding equipment.

Figure 14:
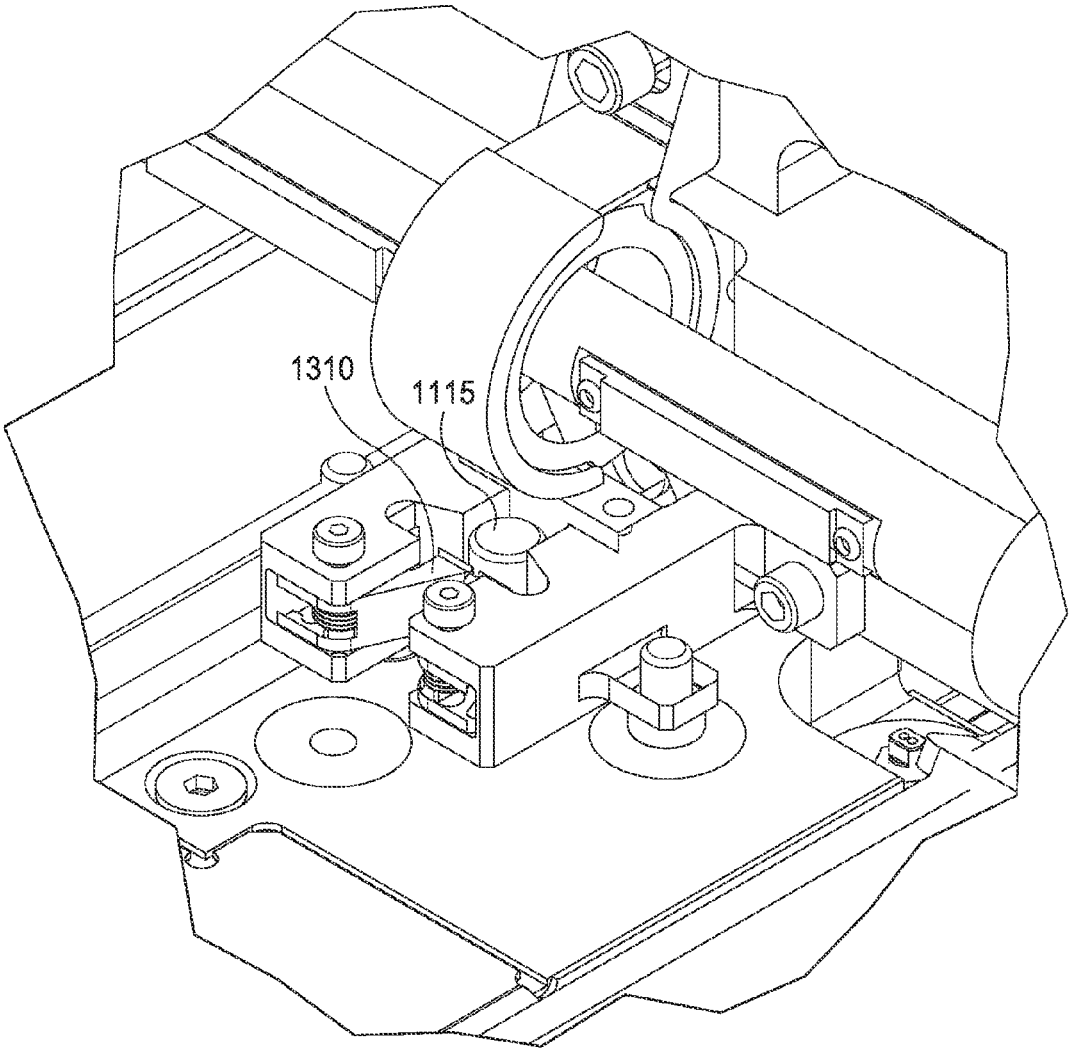
FIG. 14 illustrates a cradle clip engaged with an actuated pin of a cradle drive sled according to embodiments of the present disclosure.

Each cradle 1300-1301 includes a cradle capture clip 1310. FIG. 14 illustrates a cradle capture clip 1310 engaged with an actuated pneumatic pin 1115 of a cradle drive sled 1100 according to embodiments of the present disclosure. In certain embodiments, the capture clip 1310 includes a sensor that indicates whether the capture clip 1310 has completed engagement or capture of the CDS sled pin 1115 into the clips 1310.

Figure 15:
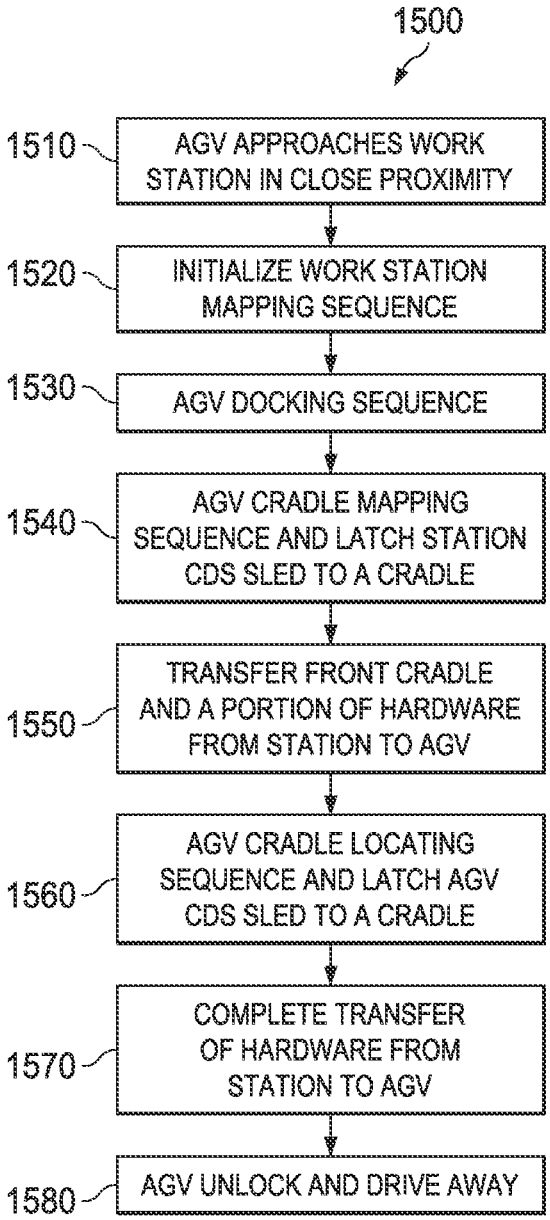
FIG. 15 illustrates a zero-lift transfer method incorporating a cradle mapping sequence according to embodiments of the present disclosure.

FIG. 15 illustrates a zero-lift transfer method 1500 according to embodiments of the present disclosure. The zero-lift transfer method 1500 incorporates a mapping sequence method according to embodiments of the present disclosure. The embodiment of the zero-lift transfer method 1500 shown in FIG. 15 is for illustration only. Other embodiments could be used without departing from the scope of this disclosure.

As a specific and non-limiting example, an implementation of the zero-lift transfer method 1500 begins with an empty AGV rail 300 and a single-loaded WS rail. The AGV is described as empty because no cradles 1300-1301 are coupled to the AGV rail 300. The WS rail is described as single loaded because only one large-scale hardware load is loaded onto the WS rail. The hardware load is coupled to two hardware cradles 1301. A front portion of the hardware load is coupled to a first hardware cradle mechanically coupled to the WS rail. A rear portion of the hardware load is coupled to a second hardware cradle 1301 mechanically coupled to the WS rail. A controller of the AGV and WS automated transfer and positioning systems 201 and 200 respectively receives user selection. The user selection instructs the AGV to dock to the empty AGV rail to the single-loaded WS rail, to transfer the single hardware load onto the AGV rail, and to drive the single-loaded AGV rail a location that is non-collinear with the WS rail.

In block 1510, the AGV drives into alignment with the work station. More particularly, the AGV drives into close proximity with the work station and substantially aligns AGV rail to the WS rail in a parallel manner. Processing circuitry within a controller of AGV and WS automated transfer and positioning systems 201 and 200 causes the AGV to position the AGV rail such that when the hydraulic system of the AGV lowers the AGV rail to be coplanar with the WS rail, the AGV rail is collinear with the WS rail.

In block 1520, when the dual vee rails of the AGV and work station are aligned, and when the common rail 300 of the AGV system 201 is docked to the common rails of the work station system 200, the CDS sled 1100 of the WS system 200 initializes a mapping sequence method. In certain embodiments, the AGV system 201 initializes a mapping sequence method. As described below, during the mapping sequence process, the system 100 determines the location, type, identifiers, and cradle brake status of each cradle coupled to the factory rail 300. In certain embodiments, after the docking mechanically couples the AGV system 201 to the WS system 200, the WS system 200 causes the utility connector to extend and couple to a utility terminal of the AGV system 201.

In a mapping sequence process, the CDS sled 1100 travels the end of the common rail, and then translates the entire length of the rail and work station rail, using the proximity sensors 1120 to look for or detect each cradle coupled to the factory rail 300, and detect their associated manual brake/ring-roll brake status. More particularly, the AGV system 201 implements a mapping sequence process using the AGV CDS sled 1100 and the AGV rail, but not the WS rail. The WS system 200 implements a mapping sequence process using the WS CDS sled 1100 and WS rail 300, but not the AGV rail. When the CDS sled 1100 moves under a cradle, such as a hardware cradle 1300, the proximity sensors 1120 identify or detect that the cradle 1300 is coupled to the common rail 300 and detect the associated manual brake and ring roll brake status of the cradle. The cradle drive system 1000 identifies the type of the detected cradle based on a code (e.g., barcode or QR code) on the servomotor 620. The reading of the servomotor's 620 code is sent to a controller of the system 100, which uses the code to determine information about the cradle 1300, such as a location of the cradle along the length of the rail. For example, the CDS 1000 identifies whether the detected cradle is a hardware cradle 1300 or a canister type cradle. The controller of the system 100 uses signals from the CDS sled 1100 to determine the location of the detected cradle, including whether the cradle is disposed on the station's factory rail 300 or the AGV's factory rail 300.

In block 1530, the AGV system 201 implements a docking process and docks to the WS system 200. More particularly, the AGV rail docks with the WS rail. That is, the AGV rail has been lowered to become coplanar, collinear, and mechanically coupled to the WS rail. Upon mechanical coupling, such as, when the AGV and WS end stop pins 310 recess, the WS utility connectors extend toward the AGV to electrically and pneumatically couple to the AGV system 201 to the electrical and pneumatic source of the WS system 200. While the AGV and WS are electrically coupled, the WS system 200 controls the AGV CDS through the utility connection.

In block 1540, the AGV system 201 initializes a mapping sequence. In certain embodiments, the WS system 200 initializes a mapping sequence method. As described above, during the mapping sequence process, the system 100 determines the location, type, and identifiers of each load and cradle coupled to the factory rail 300.

Also in block 1540, the WS CDS sled 1100 latches to the second hardware cradle 1300 coupled to the rear portion of the hardware load. That is, the capture clip 1310 of the second cradle 1300 captures the pin 1115 of the WS CDS sled. A CDS sled 1100 is not required to latch to the second cradle, and is capable of latching to any cradle 1300. In certain embodiments, the CDS 1000 instructs the WS CDS sled 1100 to couple to the loaded cradle furthest away from the AGV CDS sled 1100, enabling the WS CDS sled 1100 to translate the attached cradle 1300 the longest distance prior to transferring control over movement of the hardware load to the AGV CDS 1000 (namely, moved by the AGV CDS sled 1100).

In block 1550, in response to the latching in block 1540, the front portion of the single hardware load is transferred from the WS rail 300 to the AGV rail. The rear portion of the single hardware load, is coupled to a second cradle, which is disposed a further distance way from the front end of the WS rail (namely, further away from the AGV rail) than the first cradle coupled to the front portion of the single hardware load. To move the first cradle 1300, which is coupled to the front portion of the single hardware load, to the AGV rail, the WS system moves the rear portion of the single hardware load to the front end of the WS rail. To locate the second cradle coupled to the rear position of the single hardware load, the WS system 200 performs a partial mapping sequence, such as a cradle locating sequence, using the WS CDS sled 1100. The WS CDS sled 1100 translates the WS rail 300 sensing for the second cradle 1300 coupled to the rear portion of the hardware load. In certain embodiments, a controller of the WS system 200 sends command signals to the WS CDS sled 1100 to locate and latch to a specified cradle, such as the second cradle 1300. In certain embodiments, the command signal includes identifying information that identifies the specified cradle to be located and latched. For example, the identifying information can include the barcode or QR code of the specified cradle. In certain embodiments, while the WS CDS sled 1100 is currently coupled to the first cradle, the command signal instructs the WS CDS sled 1100 to locate a next cradle disposed closest to the first cradle, such as the second cradle 1300. In a cradle locating sequence, the CDS sled 1100 translates only the portion of the rail 300 necessary to locate and latch to the specified cradle, namely, the second cradle 1300. In response to locating the specified cradle (i.e., the second cradle 1300), the WS CDS sled 1100 latches to the second cradle 1300 coupled to the rear portion of the hardware load. Then, the WS CDS sled pushes the second cradle 1300 as close as possible to the front end of the WS rail 300, and accordingly, the rear portion of the single hardware load is pushed to the forward-most position on the WS rail. As a result, the first cradle coupled to the front portion of the hardware load longitudinally translates onto the AGV rail, and the front portion of the hardware load is disposed above the AGV rail.

The WS system 200 sends control or data signals to the AGV system 201 during the transfer of a cradle between the AGV rail and WS rail. A large-scale hardware load can be coupled to any number of cradles, such as 2, 4, or 6 cradles. In this particular embodiment, only a CDS sled 1100 of one rail can move the large-scale hardware load. That is, when the WS system 200 enables the WS CDS sled 1100 to move the cradles coupled to the hardware load, the WS system 200 sends a control signal to the AGV system 201 disabling the AGV CDS sled 1100 from moving any of the cradles coupled to the hardware load. Similarly, when the WS system 200 disables the WS CDS sled 1100 from moving the cradles coupled to the hardware load, the WS system 200 sends a control signal to the AGV system 201 enabling the AGV CDS sled 1100 to move any of the cradles coupled to both the hardware load. In certain embodiments, the AGV system 201 is configured to send enable-disable control signals to the CDS sled 1100 of the WS system 200. That is, once the AGV CDS sled 1100 engages or couples to the cradle 1300, the WS CDS sled 1100 disengages.

Although only one CDS sled 1100 is shown in this embodiment for moving large-scale hardware, more than one can be used in other embodiments. For example, in certain embodiments, one may push while the other pulls.

In block 1560, the AGV system 201 performs a cradle locating sequence, by using the AGV CDS sled 1100 to translate the AGV rail 300 sensing for the first cradle 1300 coupled to the front portion of the hardware load. In response to locating the first cradle 1300, the AGV CDS sled 1100 latches to the second cradle 1300 coupled to the front portion of the hardware load.

In block 1570, the AGV CDS sled 1100 completes the transfer of the remaining portion of the hardware from the WS rail to the AGV rail. That is, the AGV CDS sled 1100 pulls the first cradle 1300 in a direction away from the WS rail and far enough for the second cradle to couple to the AGV rail. As a result, the second cradle coupled to the rear portion of the hardware load longitudinally translates onto the AGV rail, and the rear portion of the hardware load is disposed above the AGV rail.

In block 1580, the AGV rail is single loaded, and the WS rail is empty. The WS system 200 electrically and pneumatically decouples by disengaging the WS utility connectors from the AGV power source. The AGV system 201 causes the AGV rail 300 to undock from the WS rail, including using the hydraulic system to raises the AGV rail. As a result of the undocking, the assembly stop pins 310 of the AGV rail and WS rail extend.

Figure 16:
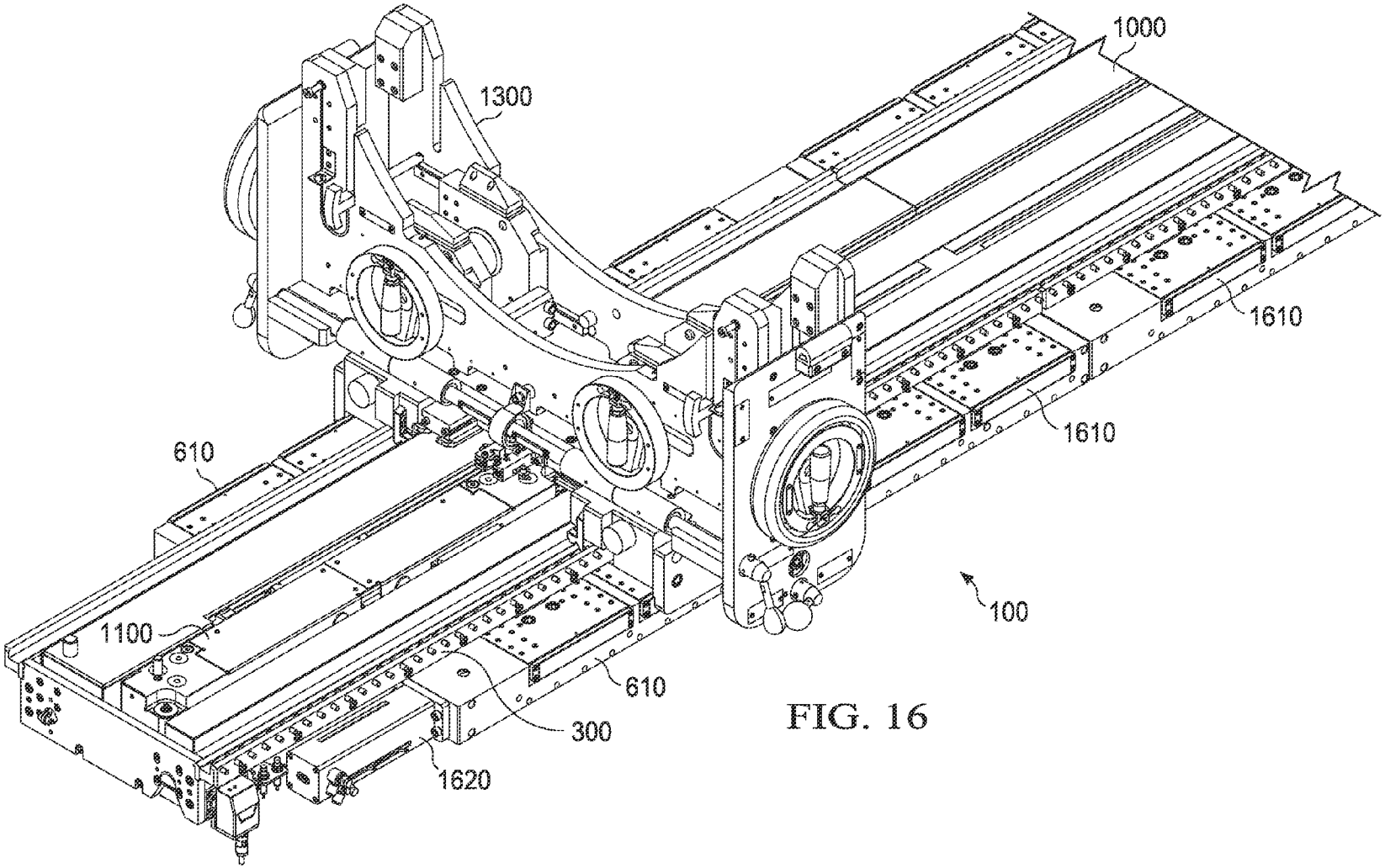
FIG. 16 illustrates an automated guided vehicle common factory rail that includes an automated cradle brake of the automated transfer and positioning system 100 for large-scale hardware of FIG. 1.

FIG. 16 illustrates an automated cradle brake 610 of an automated transfer and positioning system for large-scale hardware of FIG. 1. Although certain details will be provided with reference to the components of the cradle brake 610 for large-scale hardware, it should be understood that other embodiments may include more, less, or different components. The cradle brake 1600 includes one or more brake pads 1610, and a brake actuator cylinder 1620 that senses which the cradle brake pads 1610 are engaged. In certain embodiments, the brake plates 1610 include an array of friction brake pads arranged in a line along the length of the CFR 300.

FIG. 17 illustrates an AGV system 1701 integrated on an AGV 1710 according to embodiments of the present disclosure. Although certain details will be provided with reference to the components of the AGV system 1701 for large-scale hardware, it should be understood that other embodiments may include more, less, or different components. The AGV system 1701 includes the components and functions of the AGV system 201. The AGV system 1701 includes a utility connection terminal 1730 for receiving electrical energy from an external source, such as from a work station utility connector. The AGV system also includes a docking assembly 1720 configured to mechanically couple to a WS system 200, such as via a WS system docking assembly. The AGV docking assembly 1720 includes sensors that detect the position of the AGV common rail 300 relative to the position of the WS common rail 300, and causes the AGV common rail to mechanically align centered with the WS common rail using the hydraulic system of the AGV.

FIG. 18 illustrates a WS system 1800 according to embodiments of the present disclosure. Although certain details will be provided with reference to the components of the WS system 1800 for large-scale hardware, it should be understood that other embodiments may include more, less, or different components. The WS system 1800 includes the components and functions of the WS system 200. The WS system 1800 includes a utility connection terminal or port 1820 for transmitting electrical energy to an external source, such as to the AGV system 201, 1701 via the utility connection terminal 1730. In certain embodiments, the WS system utility connection port 1830 and the AGV system utility connection terminal 1730 are configured to couple with each other. The WS system 1800 includes a docking assembly 1830 configured to mechanically couple to the AGV system docking assembly 1720. The WS docking assembly 1820 detects the position of the AGV common rail 300 relative to the position of the WS common rail 300, and causes the AGV common rail to align centered with the WS common rail. For example, the docking assemblies 1720 and 1820 indicate to the AGV 1710 to move the AGV common rail 300 come into center alignment with the WS common rail.

Figure 19:
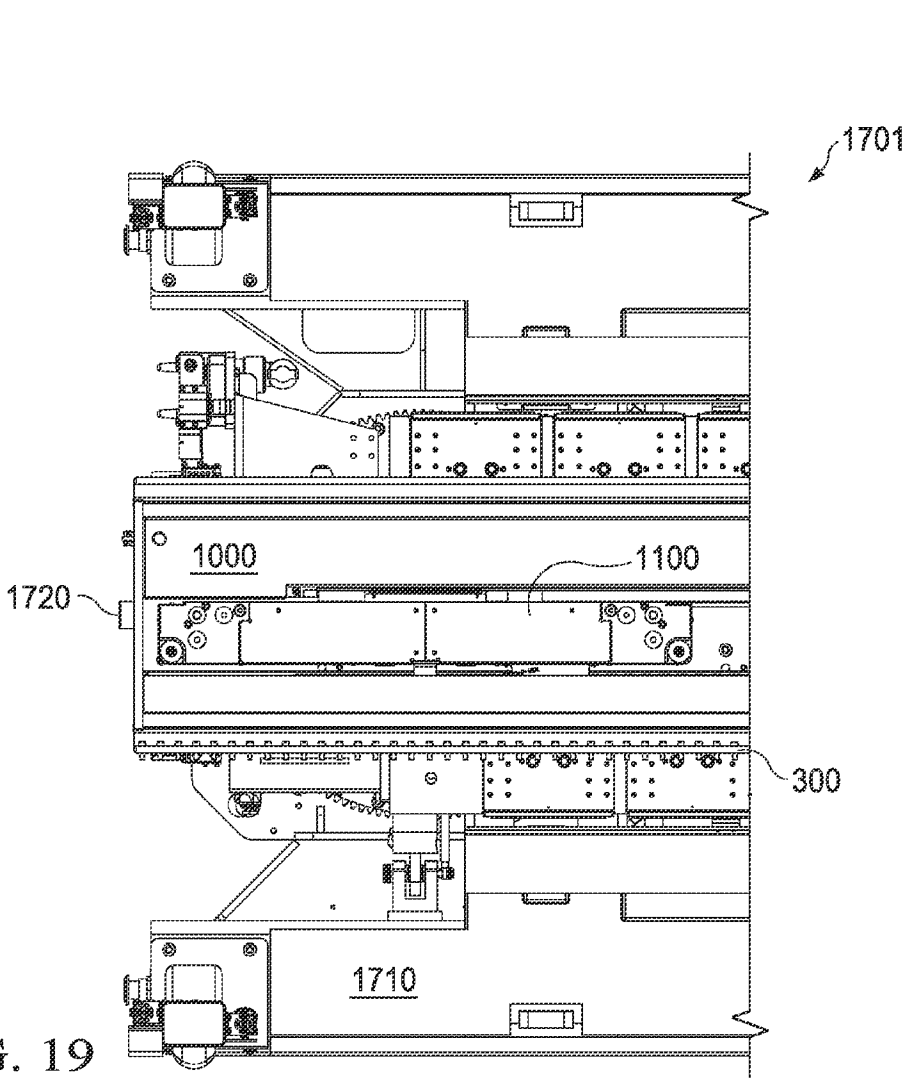
FIG. 19 illustrates a top view of the stationary assembly work station automated transfer and positioning system of FIG. 18 in close proximity to an automated transfer and positioning system of the AGV of FIG. 17.
Figure 19:
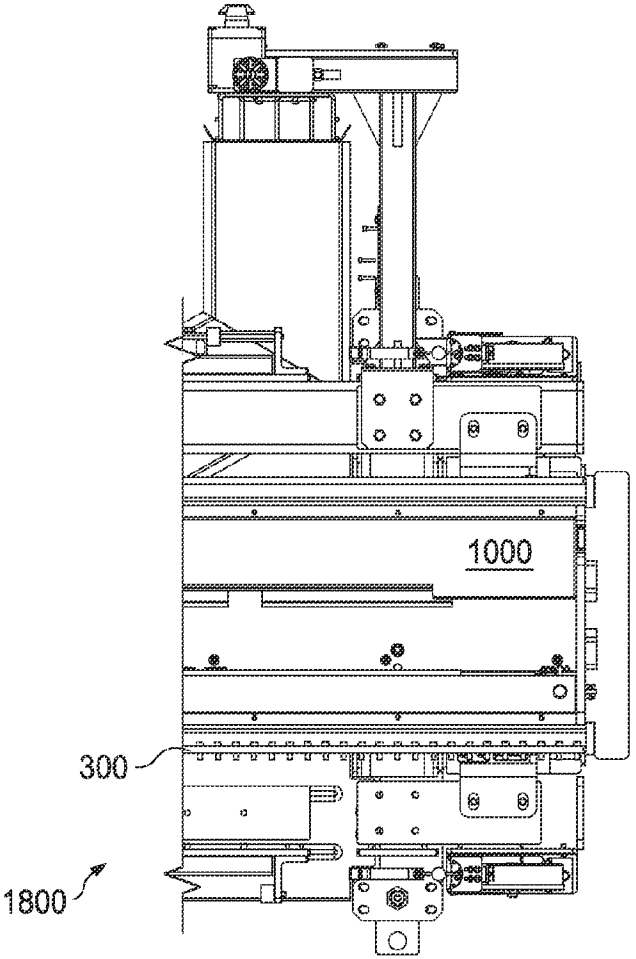

FIG. 19 illustrates a top view of the stationary assembly work station automated transfer and positioning system 1800 in close proximity to an automated transfer and positioning system 1701 of an AGV 1710.

Figure 20:
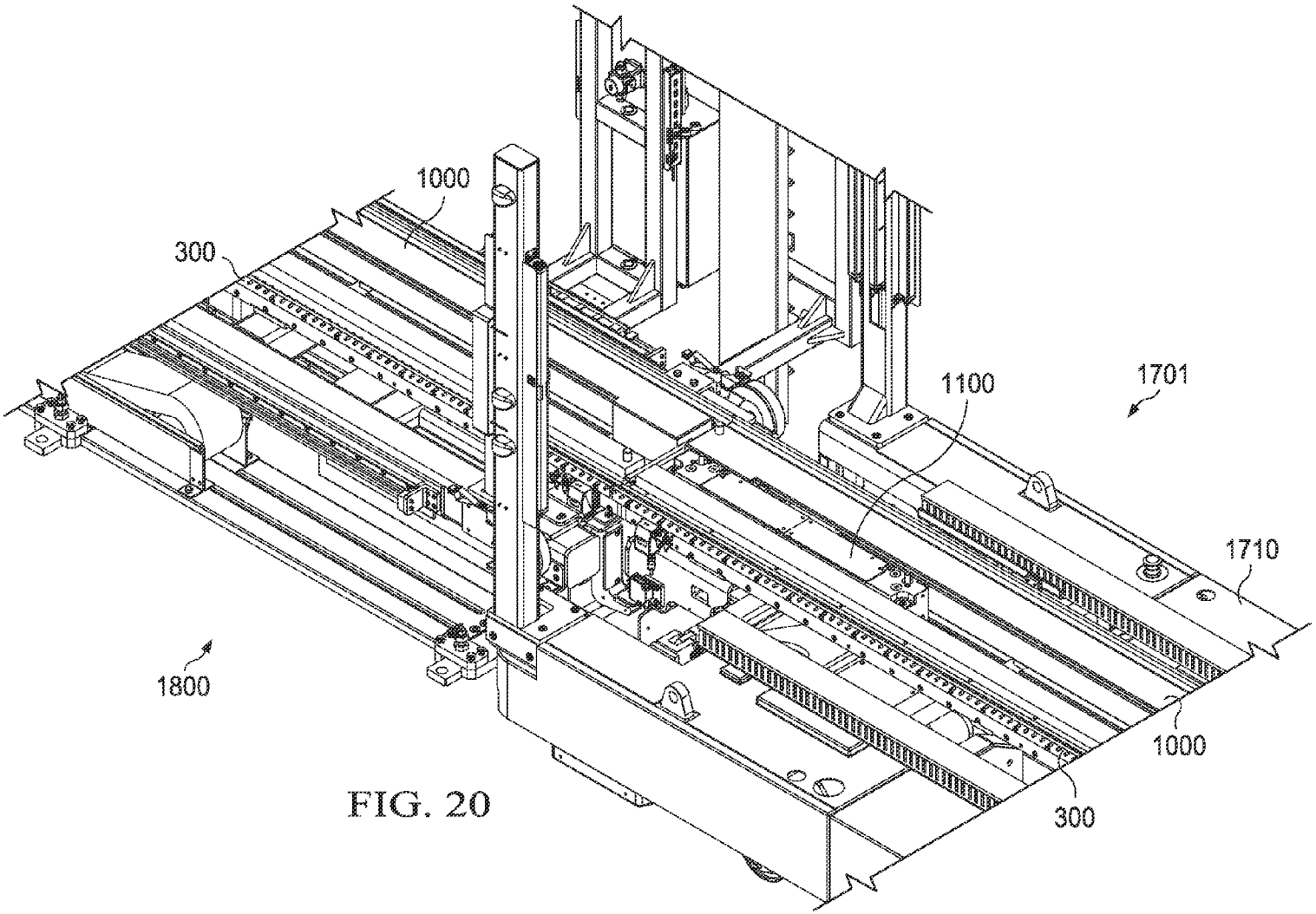
FIG. 20 illustrates a perspective view of the stationary assembly work station automated transfer and positioning system of FIG. 18 coupled to the automated transfer and positioning system of the AGV of FIG. 17.

FIG. 20 illustrates a perspective view of the stationary assembly work station automated transfer and positioning system 1800 coupled to the automated transfer and positioning system 1701 of the AGV 1710.

It is important to note that while the present disclosure includes a description in the context of a fully functional system, those skilled in the art will appreciate that at least portions of the mechanism of the present disclosure are capable of being distributed in the form of instructions contained within a machine-usable, computer-usable, or computer-readable medium in any of a variety of forms, and that the present disclosure applies equally regardless of the particular type of instruction or signal bearing medium or storage medium utilized to actually carry out the process 1500. Examples of machine usable, machine readable or computer usable, computer readable mediums include: non-volatile, hard-coded type mediums such as read only memories (ROMs) or erasable, electrically programmable read only memories (EEPROMs), and user-recordable type mediums such as floppy disks, hard disk drives and compact disk read only memories (CD-ROMs) or digital versatile disks (DVDs).

Although various features have been shown in the figures and described above, various changes may be made to the figures. For example, the size, shape, arrangement, and layout of components shown in FIGS. 1 and 14 and 16-20 are for illustration only. Each component could have any suitable size, shape, and dimensions, and multiple components could have any suitable arrangement and layout. Also, various components in FIGS. 1 through 14 and 16-18 could be combined, further subdivided, or omitted and additional components could be added according to particular needs. Further, each component in a device or system could be implemented using any suitable structure(s) for performing the described function(s). In addition, while FIG. 15 illustrates various series of steps, various steps in FIG. 15 could overlap, occur in parallel, occur multiple times, or occur in a different order.

Although an exemplary embodiment of the present disclosure has been described in detail, those skilled in the art will understand that various changes, substitutions, variations, and improvements disclosed herein may be made without departing from the spirit and scope of the disclosure in its broadest form.

None of the description in the present application should be read as implying that any particular element, step, or function is an essential element which must be included in the claim scope: the scope of patented subject matter is defined only by the allowed claims. Moreover, none of these claims are intended to invoke paragraph six of 35 USC §112 unless the exact words "means for" are followed by a participle.

What is claimed is:

1. A cradle drive system (CDS) comprising:

a sled comprising:

a pin configured to mechanically couple the sled to a cradle, the cradle configured to hold a hardware load for movement along a factory rail;

a power interface configured to provide torque that moves the hardware load; and processing circuitry configured to:

determine that the sled is mechanically coupled to the cradle based on a latch status of the pin, and in response to a determination that the sled is mechanically coupled to the cradle, initiate a transfer of the cradle and the hardware load longitudinally along the factory rail.

2. The CDS of claim 1, wherein the sled further comprises a sensor bank assembly coupled to the processing circuitry, the sensor bank assembly comprising a plurality of sensors including a proximity sensor configured to detect a presence of the cradle coupled to the factory rail.

3. The CDS of claim 1, wherein the sled further comprises a sensor bank assembly coupled to the processing circuitry, the sensor bank assembly comprising a plurality of sensors including a proximity sensor configured to detect the latch status of the pin, the latch status indicating whether the pin is captured within a capture clip based on an indication that the pin is extended and a proximity of the sled to the cradle.

4. The CDS of claim 1, wherein the sled further comprises a sensor bank assembly coupled to the processing circuitry, the sensor bank assembly comprising a plurality of sensors including a sensor configured to detect an engagement status of a cradle brake of the cradle, and wherein the processing circuitry is further configured to send an alarm to a user indicating that the cradle brake is engaged.

5. The CDS of claim 1, wherein the cradle comprises a hardware cradle configured to couple to a hardware ring.

6. The CDS of claim 5, wherein the sled further comprises a sensor bank assembly coupled to the processing circuitry, the sensor bank assembly comprising a plurality of sensors including a sensor configured to detect an engagement status of a ring roll brake of the hardware cradle.

7. The CDS of claim 1, wherein the cradle comprise a canister cradle configured to couple to a hardware canister.

8. The CDS of claim 1, further comprising:

a code reader coupled to the factory rail, the code reader configured to identify a typo of the cradle and a clearance distance associated with the hardware load held within the cradle using a code and a user-entered data.

9. The CDS of claim 1, wherein the processing circuitry is further configured, in response to receiving a sensing of the cradle on the factory rail from a proximity sensor proximate to an end of the factory rail, to trigger a code reader to read a code.

10. The CDS of claim 1, wherein the sled further comprises a sensor bank assembly coupled to the processing circuitry, the sensor bank assembly comprising a plurality of sensors including a proximity sensor configured to detect a recession of an end stop pin of an end stop assembly located proximate to an end of the factory rail.

11. A common rail system (CRS) comprising:

a factory rail;

a sled coupled to the factory rail, the sled comprising:

a pin configured to mechanically couple the sled to a cradle, the cradle configured to hold a hardware load for movement along the factory rail;

a power interface configured to provide torque that moves the hardware load; and processing circuitry configured to:

determine that the sled is mechanically coupled to the cradle based on a latch status of the pin, and in response to a determination that the sled is mechanically coupled to the cradle, initiate a transfer of the cradle and the hardware load longitudinally along the factory rail.

12. The CRS of claim 11, further comprising:

an automated guided vehicle coupled to the factory rail.

13. The CRS of claim 11, wherein the sled further comprises a sensor bank assembly coupled to the processing circuitry, the sensor bank assembly comprising a plurality of sensors including a proximity sensor configured to detect a presence of the cradle coupled to the factory rail.

14. The CRS of claim 11, wherein the sled further comprises a sensor bank assembly coupled to the processing circuitry, the sensor bank assembly comprising a plurality of sensors including a proximity sensor configured to detect the latch status of the pin, the latch status indicating whether the pin is captured within a capture clip based on an indication that the pin is extended and a proximity of the sled to the cradle.

15. The CRS of claim 11, wherein the sled further comprises a sensor bank assembly coupled to the processing circuitry, the sensor bank assembly comprising a plurality of sensors including a sensor configured to detect an engagement status of a cradle brake of the cradle, and wherein the processing circuitry is further configured to send an alarm to a user indicating that the cradle brake is engaged.

16. The CRS of claim 11, wherein the cradle comprises a hardware cradle configured to couple to a hardware ring.

17. The CRS of claim 16, wherein the sled further comprises a sensor bank assembly coupled to the processing circuitry, the sensor bank assembly comprising a plurality of sensors including a sensor configured to detect an engagement status of a ring roll brake of the hardware cradle.

18. The CRS of claim 11, wherein the cradle comprise a canister cradle configured to couple to a hardware canister.

19. The CRS of claim 11, further comprising:

a code reader coupled to the factory rail, the code reader configured to identify a type of the cradle and a clearance distance associated with the hardware load held within the cradle using a code and a user-entered data.

20. The CRS of claim 11, further comprising:

a proximity sensor coupled to each of multiple ends of the factory rail, each proximity sensor configured to sense the cradle on the factory rail;

wherein the processing circuitry is further configured, in response to receiving a sensing of the cradle on the factory rail from one of the proximity sensors, to trigger a code reader to read a code.

* * * * *